US005089068A

United States Patent [19]

Okada et al.

[11] Patent Number: 5,089,068

[45] Date of Patent: Feb. 18, 1992

[54] COLD ROLLED STEEL SHEETS HAVING IMPROVED SPOT WELDABILITY

[75] Inventors: Susumu Okada; Makoto Imanaka; Susumu Masui; Takashi Obara; Masatoshi Shinozaki; Kozo Tsunoyama, all of Chiba, Japan

[73] Assignee: Kawasaki Steel Corporation, Japan

[21] Appl. No.: 410,414

[22] Filed: Sep. 21, 1989

Related U.S. Application Data

[62] Division of Ser. No. 204,619, Jun. 9, 1988, Pat. No. 4.889,566.

[30] Foreign Application Priority Data

Jun. 18, 1987 [JP] Japan ..... 62-150313
Jun. 19, 1987 [JP] Japan ..... 62-152977
Jun. 19, 1987 [JP] Japan ..... 62-152978
Jun. 19, 1987 [JP] Japan ..... 62-152979

[51] Int. Cl.[5] ..... C22C 38/06; C22C 38/14; C22C 38/12

[52] U.S. Cl. ..... 148/328; 148/330

[58] Field of Search ..... 148/330, 12 C, 320

[56] References Cited

U.S. PATENT DOCUMENTS 4,141,761 2/1979 Abraham et al. ..... 148/327
4,504,326 3/1985 Tokunaga et al. ..... 148/12 C
4,586,966 5/1986 Okamoto et al. ..... 148/12 C
4,615,749 10/1986 Satoh et al. ..... 148/330

FOREIGN PATENT DOCUMENTS 080809 6/1983 European Pat. Off. .
228756 7/1987 European Pat. Off. .
59-74232 4/1984 Japan .
59-190332 10/1984 Japan .
59-193221 11/1984 Japan .
60-159153 8/1985 Japan ..... 148/330
60-47328 10/1985 Japan .
61-110757 5/1986 Japan .
61-113724 5/1986 Japan .
61-133323 6/1986 Japan .

*Primary Examiner*—Deborah Yee
*Attorney, Agent, or Firm*—Parkhurst, Wendel & Rossi

[57] ABSTRACT

An extra-low carbon cold rolled steel sheet useful for use in automobiles and the like, having an improved spot weldability is obtained by combining and adding Ti, Nb and B in predetermined amounts to an extra-low carbon steel to control the amount of fine Ti precipitate dispersed in steel to within a specified reasonable range. Furthermore, the spot weldability is improved by controlling the production conditions of the extra-low carbon steel sheet to within specified reasonable ranges.

6 Claims, 20 Drawing Sheets

COLD ROLLED STEEL SHEETS HAVING IMPROVED SPOT WELDABILITY

This is a division of application Ser. No. 07/204,619, filed Jun. 9, 1988, now U.S. Pat. No.4,889,566.

BACKGROUND OF THE INVENTION

1. Field of the Invention

This invention relates to a cold rolled steel sheet useful for automobiles and a method of producing the same, and more particularly to an extra-low carbon cold rolled steel sheet having an improved spot weldability without damaging excellent formability.

2. Related Art Statement

Cold rolled steel sheets having improved formabilities, particularly deep drawability are mainly applied to inner and outer panels for automobiles. Therefore, there have hitherto been made studies so as to provide optimum conditions satisfying mechanical properties required for steel sheets when the sheet is press-formed into parts for automobiles. Particularly, the steel sheets for automobiles should be adapted to a great variety of designs, so that the improvement of r-value corresponding to the deep drawability or the reduction of yield stress and improvement of work hardenability from a viewpoint of shape freezability are also important. For this end, extra-low carbon steels having a carbon content reduced to a level of about 10 ppm becomes adopted lately.

The production technique of extra-low carbon steel sheets for deep drawing developed from the above viewpoints is disclosed, for example, in Japanese Patent laid open No. 59-193,221 or in the specification of Japanese Patent Application No. 61-219,803 previously filed by the inventors.

In these techniques, however, spot weldability and properties of weld portion are not considered as important properties in addition to the formability. Particularly, the extra-low carbon steel is generally poor in spot weldability as compared with low carbon steels.

The spot welding operation is an indispensable factor in the assembling work of parts formed by pressing or other process. Therefore, the operability of such a spot welding as well as mechanical properties of weld portion are important together with the formability in view of the evaluation on total properties of the steel sheet.

Moreover, the spot weldability is barely reported in Japanese Patent laid open No. 61-110,757, but the control of the thickness of surface oxide film disclosed therein is very difficult to be applied to industrial production and is hardly practical.

In general, it has been well-known to improve elongation (El) and the Lankford value (r-value) and reduce Y.S. (low Y.R.) from a viewpoint of formabilities, particularly deep drawability and shape freezability in the press forming, which have been realized by extremely reducing the carbon content of steel sheet. However, when such an extra-low carbon steel is subjected to spot welding, the strengths are poor as compared with those of the conventional low carbon steel and the proper welding condition is shifted toward a high welding current side as compared with the conventional low carbon steel as shown in FIG. 20. The result is that a new problem arises in that the consumption of a spot welder becomes faster.

SUMMARY OF THE INVENTION

It is, therefore, an object of the invention to advantageously solve the aforementioned problems and provide a cold rolled steel sheet having improved spot weldability and mechanical properties of weld portion without damaging press formability, and a method of producing the same.

At first, the invention will be described with respect to investigational details resulting in the success of the invention.

In order to improve the formabilities or r-value and El, it is effective to reduce the C amount, and hence the steel is softened. However, the inventors have found out in the course of development and study on a technique for improving the spot weldability that the local deformation is easily caused in the excessively softened steel sheet by pressure applied from the electrode in the spot welding and hence the contact resistance between electrode and steel sheet or between steel sheets is abnormally lowered (FIG. 21). Therefore, it is considered that the shifting of the proper welding condition range in the spot welding of the extra-low carbon steel sheet results from such a lowering of the electric resistance. Thus, it becomes important to adjust the Y.S. (yield stress) as an adequate property of the steel sheet.

In order to raise Y.S., it is generally performed to increase the amount of alloying elements such as C, N, Mn, P, Si and the like, which can not avoid the reduction of r-value and El on the other hand. Furthermore, increasing the Y.S. can easily be achieved by reducing the skin pass rolling or the like, but in this case the decrease of r-value and El can not also be avoided in the conventionally known techniques. Therefore, in order to restrain the degradation of such properties to a minimum, it is necessary to obtain the effect of raising Y.S. by adding a smaller amount of the alloying element. The inventors have aimed at this point and made investigations with respect to the development of steel sheets having good work hardening properties.

On the other hand, since the extra-low carbon steel sheet is less in the amount of impurities and very large in the grain growth at the heating, the coarsening of crystal grains in the weld portion and hence the softening of the steel sheet are similarly considered to be a factor of obstructing the weldability.

The inventors have made further studies in order to solve the aforementioned problems and obtained knowledge that the simultaneous addition of Ti, Nb and B to the extra-low carbon steel is very effective for improving the strength of the spot weld portion.

And also, the inventors have made further investigations with respect to the improvement of reasonable welding current or the like based on the above knowledge and obtained the following discoveries:

1. It has been discovered that the work hardening properties are improved by reducing the grain size of Ti precipitates formed through the addition of Ti without adding a great amount of the alloying element and also Y.S. can effectively be raised by a small reduction of skin pass rolling.

Furthermore, it has been proved that it is important how much the precipitates having a grain size of not more than 0.05 μm are dispersed into steel for linking the dislocation introduced by skin pass rolling with the interaction of fine precipitate to effectively raise the Y.P. (yield point).

Moreover, it has been elucidated that in the thus obtained steel sheets, not only the spot weldability is improved but also the properties of weld portion such as strength and toughness are improved so as to match with those of the base metal.

2. It has been confirmed that the strengths of spot weld portion are very effectively improved by simultaneously adding Ti, Nb and B to the extra-low carbon steel and controlling the coexistent state of these elements to a particular range and subjecting the steel to adequate steps.

That is the effect of raising the hardness of the weld portion is first obtained when the three elements of Ti, Nb and B are coexistent together, and if either one of these elements is lacking, the improving effect of the weldability is not observed. Even in the conventional steel sheets for deep drawing, there are proposed many steels of Ti-Nb series, Ti-B series, Nb-B series and the like, but these proposals aim at the effect of improving mechanical properties by each of these elements alone (for example, improvement of El, r-value and the like), so that the addition effect of each element of Ti, Nb and B is independent with each other and merely additional, which can be well be explained from the conventionally known theory of recrystallization structure formation.

However, in order to achieve the effect aimed at by the invention, it is necessary to add reasonable amounts of three elements Ti, Nb and B or to coexist three elements under a delicate balance, which is largely different from the conventional Ti, Nb or B containing steel sheet for deep drawing. That is, all of the conventionally proposed Ti, Nb or B containing steels for deep drawing aim at only the improvement of deep drawability, so that they are said to be a steel containing an excessive amount of Ti, Nb, B or the like or a steel wherein a balance among these three elements is unsuitable in view of the spot weldability. Therefore, it is considered that these conventional steels do not provide the good spot weldability aimed at by the invention.

It has also found out that the production steps, particularly the skin pass rolling step play an important role for sufficiently developing the above effect.

In general, the skin pass rolling is not necessarily required because the extra-low carbon steel is very small in the amount of solute element and does not generate the yield elongation. That is, the purpose of the skin pass rolling in the extra-low carbon steel is different from that of the low carbon steel and is shape remedy and surface adjustment for the most, so that it is considered that in case of the extra-low carbon steel, the skin pass rolling is not completely needed or is sufficient at a very slight reduction.

According to the invention, it has been succeeded that the fatigue properties of the spot weld portion, particularly fatigue properties at a low cycle are advantageously improved by setting the reduction of the skin pass rolling at a value higher than the usual value without substantially scarifying the other properties.

3. It has been discovered that the spot weldability is advantageously improved without raising the Y.S. by performing the skin pass rolling with a work roll subjected to dulling, preferably laser dulling to make the surface roughness of the steel sheet large or restrict the area of convex portion on the steel sheet surface.

That is, it has been confirmed that when the surface roughness of the steel sheet is made large to reduce the contacting area between the steel sheets, the electric resistance in the welding becomes large and consequently the welding current value can be decreased.

Of course, it is possible to increase Y.S. without damaging the r-value and El by the above items 1 and 2, but the invention is suitable for applications not requiring the increase of Y.S. such as an application that the shape freezability or difference in size between working press mold and steel sheet after the working is required to be very small.

The invention is based on the aforementioned knowledges.

According to a first aspect of the invention, there is the provision of a cold rolled steel sheet having improved strength and toughness in weld portion, characterized in that said steel comprises not more than 0.004 wt % of C, not more than 0.1 wt % of Si, not more than 0.5 wt % of Mn, not more than 0.025 wt % of P, not more than 0.025 wt % of S, not more than 0.0040 wt % of N, 0.01~0.04 wt % of Ti, 0.003~0.010 wt % of Nb, 0.0001~0.0010 wt % of B, 0.01~0.10 wt % of Al and the remainder being substantially Fe, and fine precipitates of Ti having a grain size of not more than 0.05 μm are uniformly dispersed into said steel in an amount of not less than 30 ppm as a Ti conversion amount.

According to a second aspect of the invention, there is the provision of a cold rolled steel sheet having improved formability and spot weldability, characterized in that said steel comprises not more than 0.004 wt % of C, not more than 0.1 wt % of Si, not more than 0.5 wt % of Mn, not more than 0.025 wt % of P, not more than 0.025 wt % of S, 0.01~0.04 wt % of Ti, 0.001~0.010 wt % of Nb, 0.0001~0.0010 wt % of B, 0.01~0.10 wt % of Al and the remainder being substantially Fe, and has a surface roughness satisfying either one of the following (a) and (b):

(a) surface roughness (SRa) and yield stress (Y.S.) satisfy the following relationship:

$$SRa \geqq (32.4/Y.S.) - 1.1;$$

(b) an area ratio of convex portions on the surface of said steel sheet (SSr) is not more than 60% and an average area per one convex portion (SGr) is not less than $2\times10^4$ $\mu m^2$.

According to a third aspect of the invention, there is provided a method of producing a cold rolled steel sheet having improved strength and toughness in weld portion, which comprises subjecting molten steel comprising not more than 0.004 wt % of C, not more than 0.1 wt % of Si, not more than 0.5 wt % of Mn, not more than 0.025 wt % of P, not more than 0.025 wt % of S, not more than 0.0040 wt % of N, 0.01~0.04 wt % of Ti, 0.003~0.010 wt % of Nb, 0.0001~0.0010 wt % of B, 0.01~0.10 wt % of Al and the remainder being substantially Fe to a solidification and cooling step, during which said molten steel is cooled at a cooling rate of not less than 3° C./min within a temperature range of at least 1,300°~1,000° C., and heating the resulting slab to a temperature of not higher than 1,200° C., and subjecting said slab to hot rolling and cold rolling, and then subjecting the slab to a continuous annealing within a temperature range of 700~900° C.

According to a fourth aspect of the invention, there is provided a method of producing a cold rolled steel sheet having improved spot weldability, which comprises hot rolling a slab of steel comprising not more than 0.004 wt % of C, not more than 0.1 wt % of Si, not more than 0.5 wt % of Mn, not more than 0.025 wt % of P, not more than 0.025 wt % of S, not more than 0.0040 wt % of N, 0.01~0.04 wt % of Ti, 0.001~0.010 wt % of Nb, 0.0001~0.0010 wt % of B, 0.01~0.10 wt % of Al and the remainder being substantially Fe, and satisfying the following relations (1)~(4):

$$(11/93)Nb-0.0004 \leqq B \leqq (11/93)Nb+0.0004 \quad (1)$$

$$Ti>(48/12)C+(48/14)N \quad (2)$$

$$NB<1/5\cdot(93/48)Ti \quad (3)$$

$$C+(12/14)N+(12/11)B>0.0038 \quad (4)$$

under conditions that a finish temperature is 700°~900° C. and a coiling temperature is 300°~600° C., and cold rolling the resulting hot rolled sheet at a reduction of 60~85%, and subjecting the resulting cold rolled sheet to a continuous annealing within a temperature range of from recrystallization temperature to not higher than 780° C.

According to a fifth aspect of the invention, there is provided a method of producing a cold rolled steel sheet having improved fatigue properties in spot weld portion, which comprises hot rolling a slab of steel comprising not more than 0.004 wt % of C, not more than 0.1 wt % of Si, not more than 0.5 wt % of Mn, not more than 0.025 wt % of P, not more than 0.025 wt % of S, not more than 0.0040 wt % of N, 0.01~0.04 wt % of Ti, 0.001~0.010 wt % of Nb, 0.0001~0.0010 wt % of B, 0.01~0.10 wt % of Al and the remainder being substantially Fe, and satisfying the following relations (1)~(4):

$$(11/93)Nb-0.0004 \leqq B \leqq (11/93)Nb+0.0004 \quad (1)$$

$$Ti>(48/12)C+(48/14)N \quad (2)$$

$$Nb<1/5\cdot(93/48)Ti \quad (3)$$

$$C+(12/14)N+(12/11)B>0.0038 \quad (4)$$

under conditions that a finish temperature is 700°~900° C. and a coiling temperature is 300°~600° C., and cold rolling the resulting hot rolled sheet at a reduction of 60~85%, and subjecting the resulting cold rolled sheet to a continuous annealing within a temperature range of from recrystallization temperature to not higher than 780° C., and then subjecting to a skin pass rolling at a reduction of not less than (sheet gauge (mm)+0.1)% but not more than 3.0%.

BRIEF DESCRIPTION OF THE DRAWINGS

The invention will be described with reference to the accompanying drawings, wherein.

DESCRIPTION OF THE PREFERRED EMBODIMENTS

The invention will be described in detail below.

Figure 1:
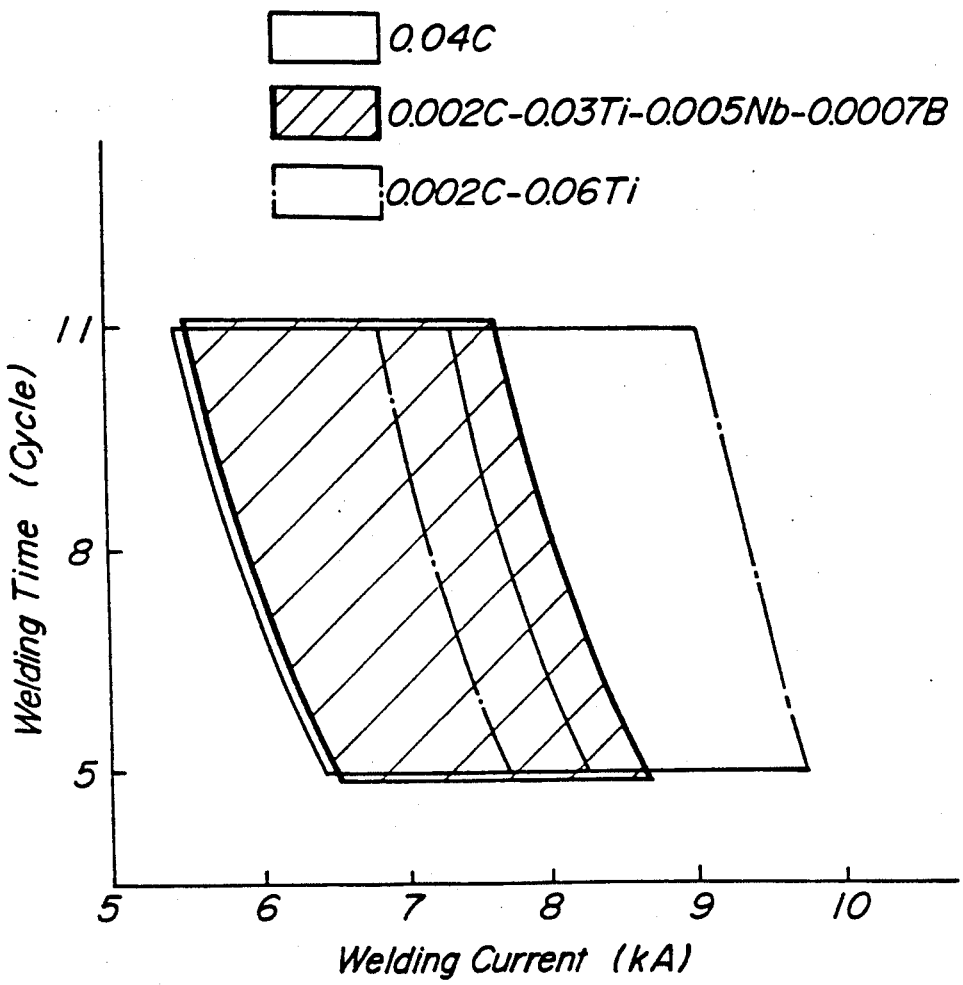
FIG. 1 is a graph showing an influence of Ti, Nb and B addition upon spot weldability.

FIG. 1 shows results obtained by examining an influence of addition of Ti, Nb and B, which are particularly important components in the invention, upon the spot weldability.

As a test steel for this experiment, there were used the usually used low carbon steel for deep drawing containing C: 0.04%, Si: 0.01%, Mn: 0.20%, P: 0.01%, N: 0.0040% and Al: 0.036%, the conventional Ti added extra-low carbon steel based on C: 0.002%, Si: 0.1%, Mn: 0.1%, P: 0.01%, S: 0.01%, Al: 0.02% and N: 0.002~0.003% and containing Ti: 0.06%, and Ti-Nb-B added extra-low carbon steel according to the invention containing Ti: 0.03%, Nb: 0.005% and B: 0.0007%.

Moreover, the spot welding was carried out by welding a specimen of 0.8×30×30 mm under an applied pressure of 190 kgf through CF type electrode of 4.5 mm in diameter with reference to a value recommended by RWMA (Resistance Welder Manufacturer's Association).

In this case, the lower limit of the reasonable welding current is a point that a nugget zone formed by the welding is not less than $3\sqrt{t}$ mm (t is sheet gauge of specimen, mm), while the upper limit thereof is a point of generating expulsion.

As seen from FIG. 1, in the conventional Ti added extra-low carbon steel, the reasonable welding current considerably shifts toward a high current side as compared with the case of the conventional low carbon steel, resulting in the requirement of large welding equipment, while in the Ti-Nb-B added extra-low carbon steel according to the invention, the lower limit of the reasonable welding current is approximately equal to that of the low carbon steel, while the upper limit of the reasonable welding current regulated by the occurrence of expulsion is shifted toward a high current side as compared with that of the low carbon steel, so that the range of the reasonable welding current is more enlarged as compared with that of the low carbon steel.

Figure 3:
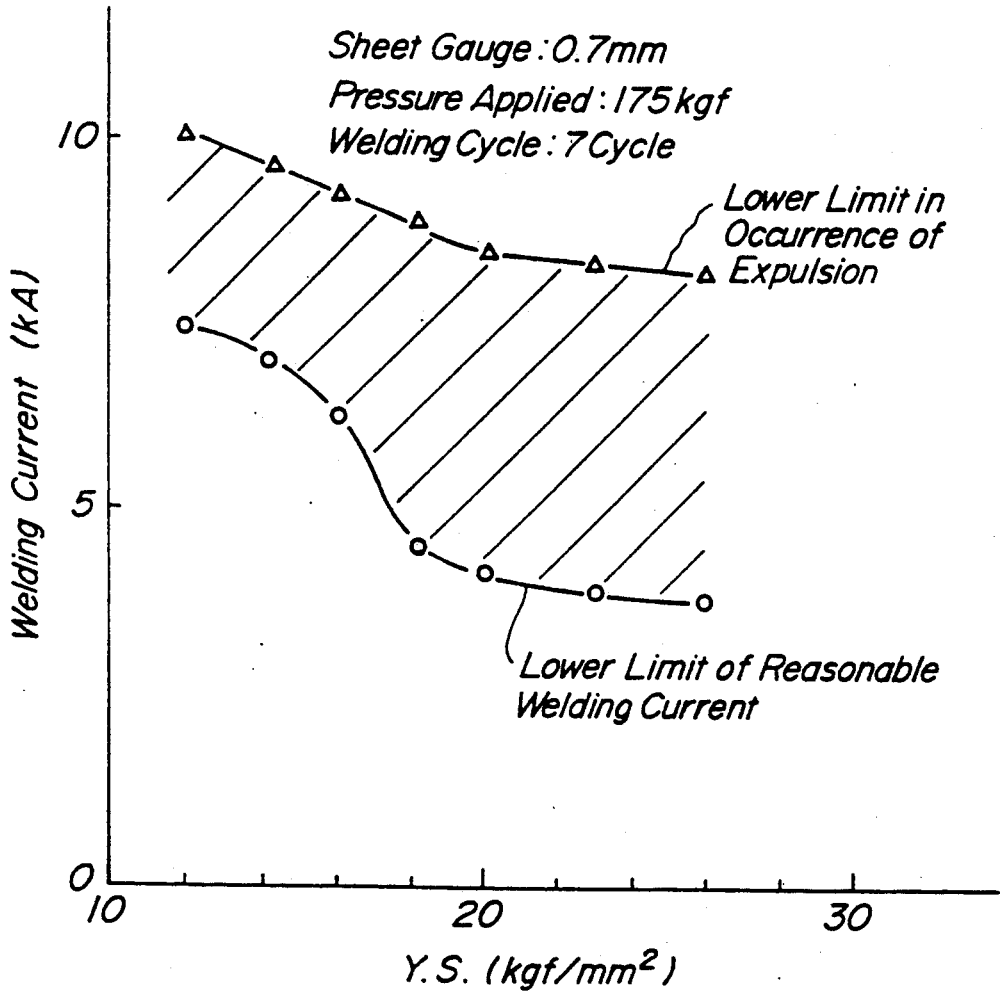
FIG. 3 is a graph showing a relation between Y.S. of steel sheet and range of reasonable welding current.

Such an effect is considered to result from the optimization of softening degree of the steel sheet. FIG. 3 shows results obtained by examining a relation between Y.S. of the steel sheet and range of the welding current.

A slab of steel obtained by varying the C amount within a range of 0.002% to 0.4% (Si: 0.01%, Mn: 0.1~0.3%, P: 0.01~0.02%, S: 0.01~0.02%, N: 0.002~0.005%, Al: 0.01~0.04%, Ti: 0.03%, Nb: 0.005%, B: 0.0007%) was heated to 1,100°~1,250° C. and hot rolled at a finish temperature of 700°~1,000° C. and a coiling temperature of 450°~700° C., and the resulting hot rolled sheet was cold rolled at a reduction of 60~85%, and thereafter the resulting cold rolled sheet was subjected to a continuous annealing within a temperature range of 700°~880° C. to obtain sheets having various Y.S. values.

The spot welding was carried out in the same manner as in the case of FIG. 1 except that the thickness of the specimen was 0.7 mm, the welding time was 7 cycles and the applied pressure was 175 kgf.

As seen from FIG. 3, the reasonable welding current range is strongly affected by the Y.S. value of the steel sheet. When Y.S. is lower than 19 kgf/mm$^2$, the reasonable welding current range considerably shifts toward a high current side.

In order to harden the steel sheet while maintaining the good deep drawability, it is effective to simultaneously add Ti, Nb and B to the extra-low carbon steel.

In the following Table 1 are shown results measured on the mechanical properties of low carbon steel and extra-low carbon steel having various chemical compositions. In this case, the composition and production conditions of the test steel are the same as in FIGS. 1 and 3 except that Ti, Nb and B were properly added within ranges of Ti: 0.02~0.04%, Nb: 0.005~0.008% and B: 0.0005~0.0008%, respectively.

TABLE 1

| Kind of steel | | Y.S. (kgf/mm$^2$) | T.S. (kgf/mm$^2$) | El (%) | r-value |
|---|---|---|---|---|---|
| Extra-low carbon steel sheet | addition of Ti, Nb, B | 20.8 | 31.2 | 48.5 | 2.0 |
| | addition of Nb, B | 14.1 | 30.4 | 48.1 | 2.0 |
| | addition of Ti, B | 11.6 | 30.2 | 48.0 | 1.8 |
| | addition of Ti, Nb | 12.2 | 29.8 | 48.3 | 1.9 |
| | no addition | 10.3 | 28.7 | 48.8 | 1.5 |
| Low carbon steel sheet | | 22.0 | 33.0 | 45.2 | 1.7 |

As seen from Table 1, in the steel sheet added with three elements of Ti, Nb and B, Y.S. is considerably improved as compared with the other extra-low carbon steel sheets, while El and r-value are substantially unchanged, and there is no degradation of the deep drawability. In this connection, the low carbon steel has Y.S. level approximately equal to that of the Ti-Nb-B added extra-low carbon steel, but the deep drawability is remarkably poor as compared with that of the extra-low carbon steel.

Figure 2:
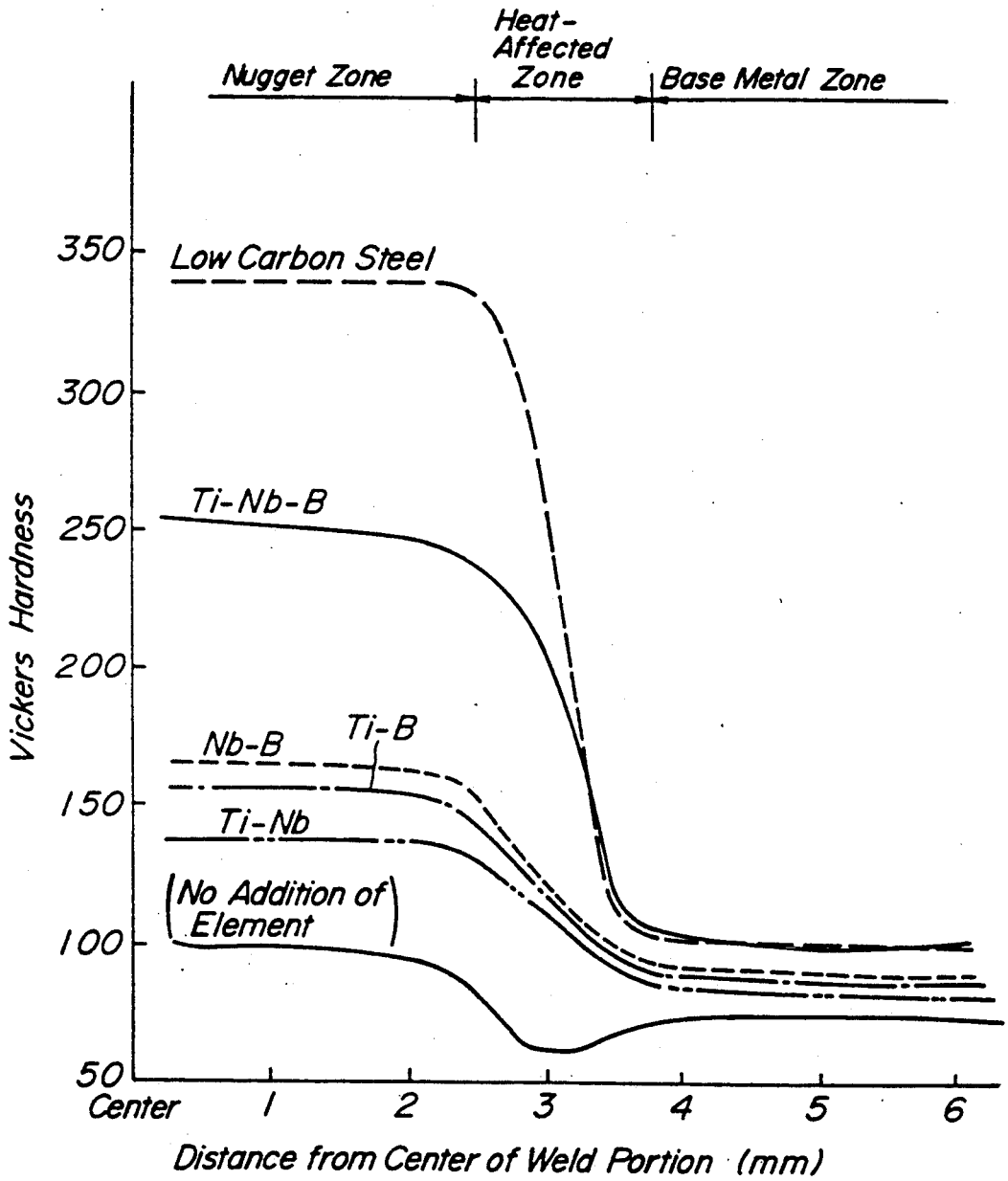
FIG. 2 is a graph showing an influence of Ti, Nb and B addition upon hardness of weld portion.

In FIG. 2 are shown results measured on the hardness of weld portion when the steel sheets shown in Table 1 are subjected to a spot welding.

As seen from FIG. 2, the base metal hardness approximately equal to that of the low carbon steel is obtained in the Ti Nb-B added extra-low carbon steel according to the invention, while in the other extra-low carbon steels lacking either one of Ti, Nb and B, only the low base metal hardness is obtained.

Furthermore, the Ti-Nb B added extra-low carbon steel according to the invention has an advantage that the hardness of the nugget zone is high as compared with the other extra-low carbon steels. In general, when the hardness of the spot weld portion or its neighborhood is low, the spot weld portion is undesirably fractured before the fracture of the base metal and the welding strength can not sufficiently be raised. In this connection, the hardness of weld portion in the conventional extra-low carbon steel is insufficient.

When the hardness of weld portion is raised to such an extent that the base metal is fractured before the fracture of the spot weld portion, even if the hardness is increased thereabove, the spot welding strength is not affected principally. The steel according to the invention and the conventional low carbon steel correspond to such a state.

Of course, such an effect is not obtained only by merely adding Ti, Nb and B to the steel sheet. That is, the reasonable addition range of each element of Ti, Nb and B based on some metallurgical interactions as well as the requirements for producing desired texture are existent for obtaining this effect.

Figure 4:
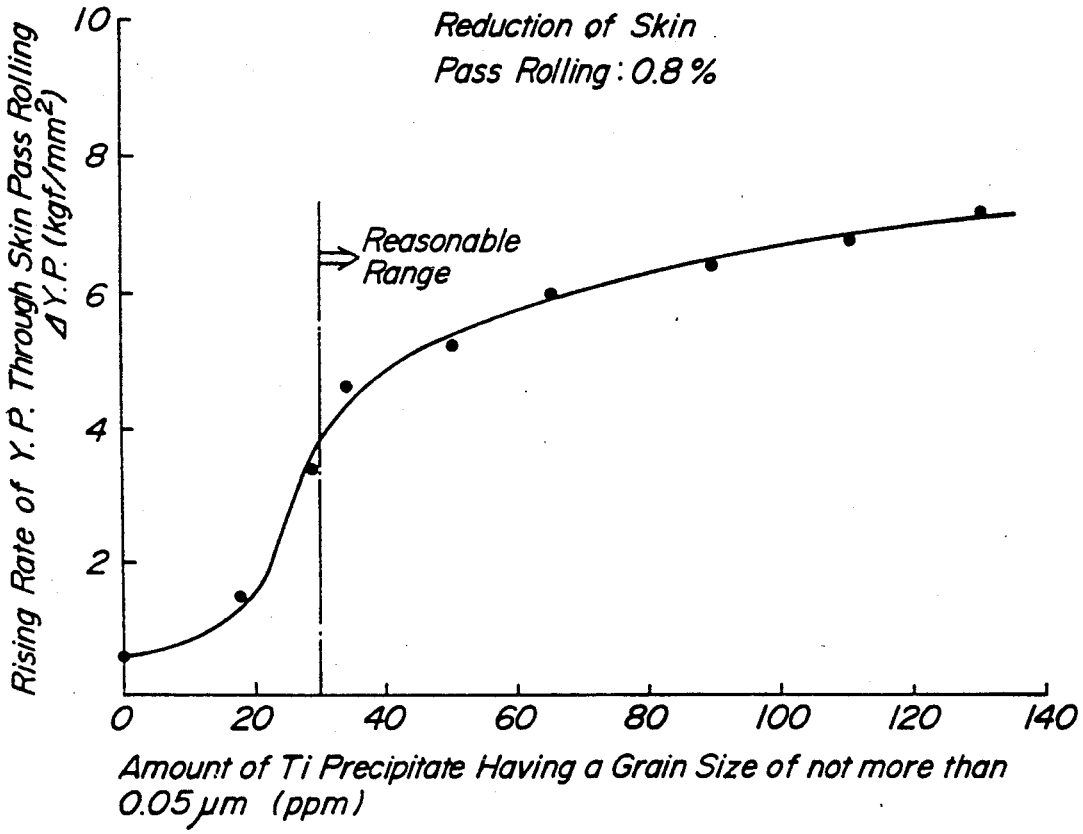
FIG. 4 is a graph showing a relation between amount of Ti precipitate having a grain size of not more than 0.05 μm as Ti conversion amount and rising rate of Y.P. through skin pass rolling.

FIG. 4 shows results measured on the influence of Ti fine precipitate upon Y.P. of steel as a relation between the amount of Ti precipitate having a grain size of not more than 0.05 μm as Ti conversion amount and the rising rate of Y.P. through skin pass rolling (reduction: 0.8%). As seen from FIG. 4, when the amount of fine precipitate as Ti conversion amount is not less than 30 ppm, the rising rate of Y.P. (ΔY.P.) increases even at the same reduction of skin pass rolling.

Such a rising rate of Y.P. is advantageous to prevent the degradation of the weldability resulted from the excessive softening in the extra-low carbon steel. That is, when the fine Ti precipitates are dispersed into steel, Y.S. rises at a small reduction of skin pass rolling in the extra-low carbon steel, and consequently the contact resistance increases in the spot welding, so that the heat generating efficiency can be increased at the same welding current.

The feature of the invention lies in the elucidation of conditions that the above change advantageously acts to the mechanical properties.

And also, this is advantageous to improve the properties of weld portion. That is, such an effect is obtained even at TIG and MIG weld portions likewise the spot weld portion. When the steel sheet is heated at a high temperature for a short time in the welding, the Ti precipitates finely dispersed in steel not only restrains the coarsening of the structure in the heating but also serves as a steel transformation site in the cooling to make the structure of the weld portion very fine, and consequently the strength and toughness of the weld portion are improved.

In the steel according to the invention, the dispersion effect of Ti precipitate is enhanced by the combined addition of Nb and B.

Moreover, the press formability and the like naturally required in the thin steel sheet besides the above effect are sufficiently compensated by reducing the C amount to not more than 40 ppm as far as possible.

The reason why the chemical composition of the steel according to the invention is limited to the above range is based on the following facts.

C:

In order to improve El and r-value by softening of steel, it is advantageous to reduce the C amount as far as possible. When the C amount exceeds 0.0040%, the mechanical properties begin to largely degrade, so that the upper limit is 0.0040%.

Si, Mn:

Each of Si and Mn effectively acts as a deoxidizing agent, but the excessive addition amount causes the damage of ductility. Therefore, the upper limit is Si: 0.1% and Mn: 0.5%, respectively.

P, S:

Since each of P and S is an impurity element, it is desirable to reduce these elements as far as possible. Each of these elements is allowed to be not more than about 0.025%.

N:

It is advantageous to reduce the N amount as far as possible likewise the C amount for softening the steel sheet to improve El and r-value. When the N amount exceeds 0.0040%, the properties such as formability, resistance to aging and the like begin to largely degrade, so that the upper limit is 0.0040%.

The fine precipitate of Ti is mainly TiN, so that the formation of fine TiN as Ti precipitate may more advantageously be attained by controlling the amounts of Ti and N. That is, the Ti precipitates having a grain size of not more than 0.05 μm are obtained by limiting the weight ratio of Ti to N to a range of 1.7~6.8.

Figure 5:
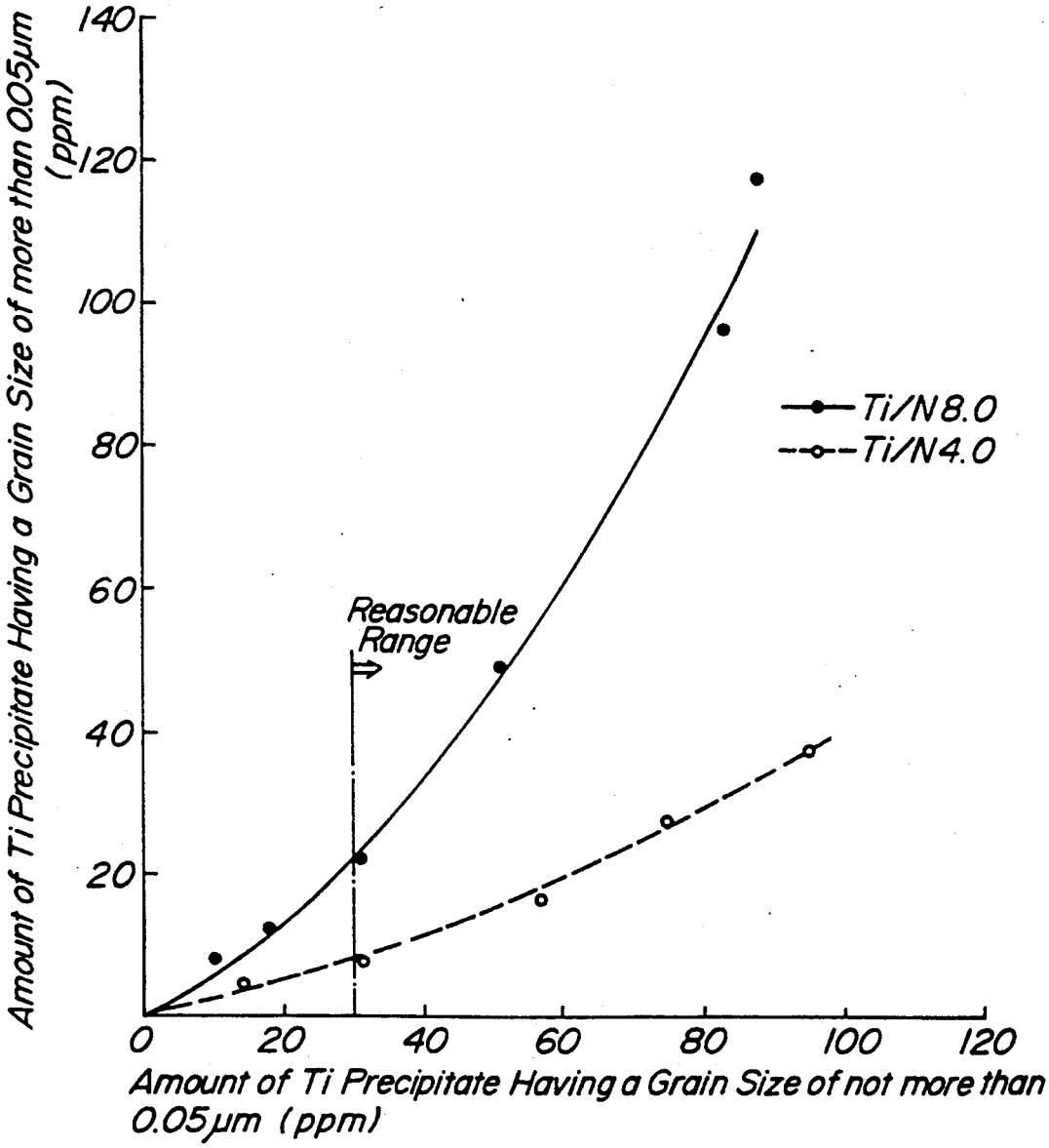
FIG. 5 is a comparison graph showing amounts of Ti precipitates having a grain size of not more than 0.05 μm or more than 0.05 μm as a parameter of Ti/N.

When the same amount of Ti precipitate having a grain size of not more than 0.05 μm is ensured at the weight ratios Ti/N of 4.0 and 8.0, the amount of Ti precipitate having a grain size of more than 0.05 μm was measured to obtain results as shown in FIG. 5.

As seen from FIG. 5, when Ti/N (=4.0) is within a range of 1.7~6.8, the fine Ti precipitates are obtained on average as a whole.

The increase in the amount of coarse Ti precipitate means that the useless Ti precipitate exhibiting a weak dispersing effect is included in a great amount, so that it is not only disadvantageous in the effective utilization of the aforementioned Ti precipitate but also causes the degradation of the formability and the rise of the cost.

When the ratio Ti/N is less than 1.7, the TiN amount becomes less to the N amount and the sufficient amount of solute B can not be ensured, while when it exceeds 6.8, the absolute amount of TiN increases, but the ratio of fine precipitate reduces, so that it is desirable to add Ti and N so as to satisfy the range of weight ratio Ti/N of 1.7~6.8.

Figure 6:
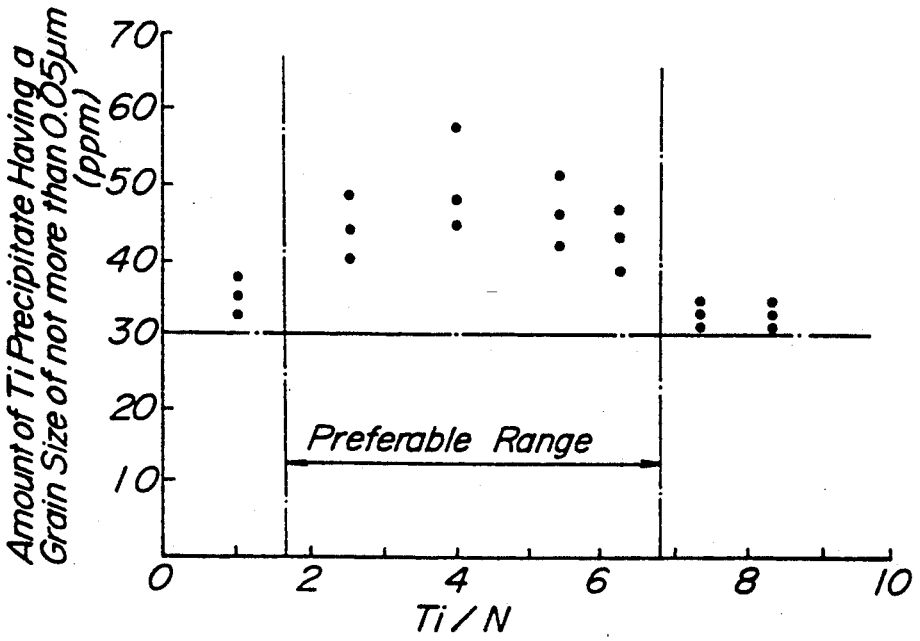
FIG. 6 is a graph showing a relation between Ti/N ratio and amount of Ti precipitate having a grain size of not more than 0.05 μm.

FIG. 6 shows a relation between Ti/N ratio and amount of fine Ti precipitate having a grain size of not more than 0.05 μm, from which it is apparent that the better results are obtained when the ratio Ti/N is within a range of 1.7~6.8.

Moreover, when the S amount is limited to not more than 0.01% at the above defined range of the ratio Ti/N, the precipitation of TiS is suppressed to prevent needless disappearance of Ti, which is particularly advantageous for more enhancing the precipitation of fine Ti precipitate.

Al:

Al is added in an amount of not less than 0.01% for providing the deoxidizing effect. However, the upper limit of Al added is 0.10% in order to prevent the bad influence upon the mechanical properties as an impurity.

Nb:

Nb is an element useful for making the structure of spot weld portion to raise the hardness of the weld portion under the coexistence with B.

Furthermore, Nb effectively contributes to raise Y.P. with holding high El and r-value by the combined addition with Ti.

This effect is appeared when the Nb amount is 0.010%, the excessive rise of Y.P. and the decrease of El are brought about, so that the amount is limited to a range of 0.001~0.010%. Moreover, it is desirable to add Nb in an amount of not less than 0.003% in order to finely disperse the Ti precipitate.

However, if it is intended to raise Y.S. irrespective of Ti precipitate, as the ratio of Nb to Ti becomes high, the amount of NbC precipitated increases to degrade the mechanical properties, so that the coiling temperature should be not lower than 600° C. and consequently the amount of Nb added is necessary to be reduced in balance with Ti. Particularly, when the atomic ratio of Nb to Ti is not less than 0.2, the degradation of mechanical properties is poor, so that the ratio of Nb to Ti is necessary to be $Nb/Ti<1/5$ as an atomic ratio or $Nb<1/5(93/48)Ti$ as a weight ratio.

Figure 12:
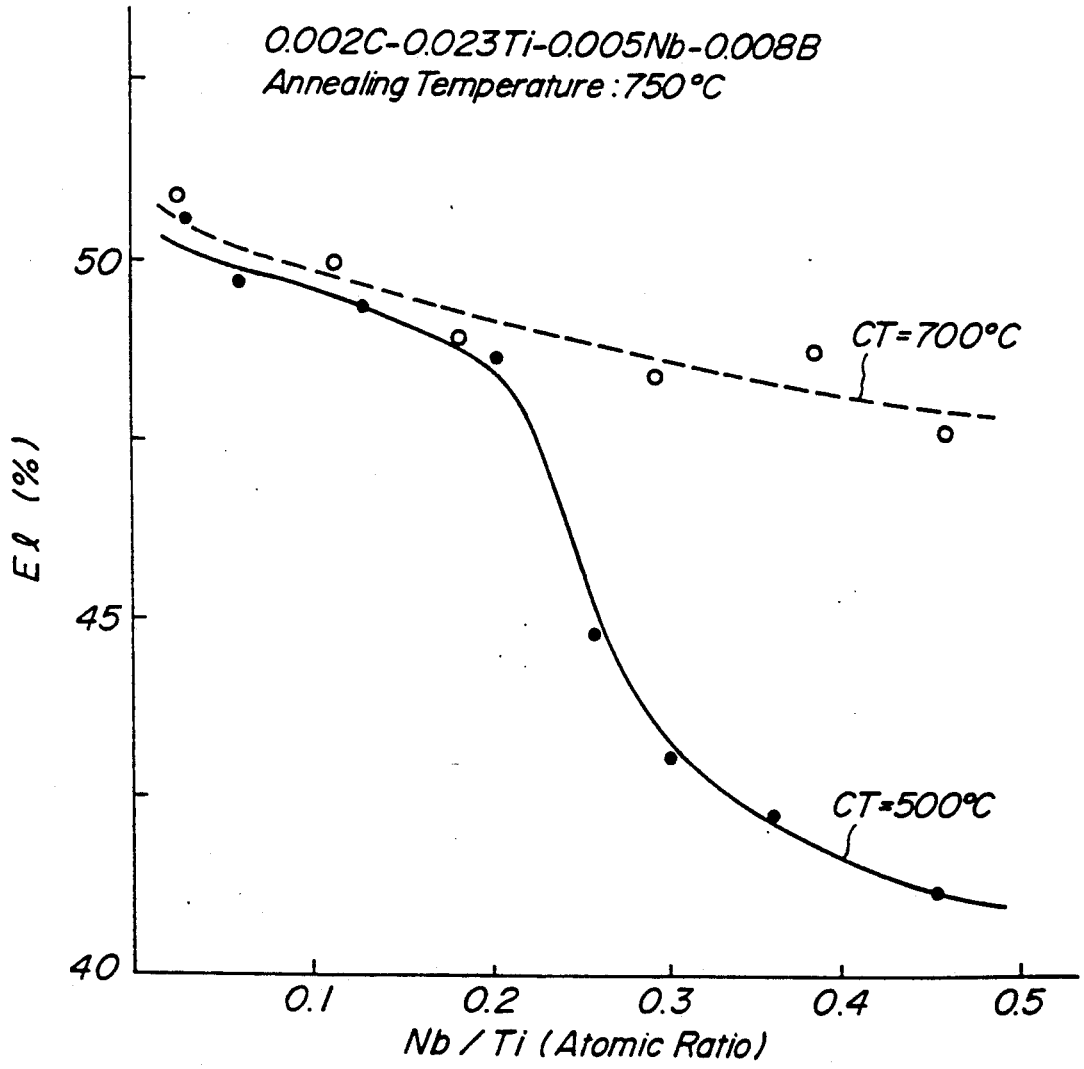
FIG. 12 is a graph showing an influence of Nb/Ti upon El of steel sheet.

In FIG. 12 are shown results examined with respect to the influence of Nb/Ti (atomic ratio) upon El. As seen from FIG. 12, El rapidly lowers when Nb/Ti is not less than 0.2.

B:

B is useful for raising the strengths of spot weld portion and base metal, particularly Y.S. by adding in a slight amount in the presence of Nb and/or Ti. This effect is recognized by adding not less than 0.0001% of B, but when the amount is too large, the degradation of mechanical properties is caused, so that the upper limit is 0.0010%.

Moreover, in order to satisfactorily develop the above effect irrespective of Ti precipitate, the B amount is insufficient to merely satisfy the above range, and is important to be limited to a range of $(11/93)Nb-0.0004 \leqq B \leqq (11/93)Nb+0.0004$ in balance with the Nb amount.

The coexisting effect of Nb and B was examined to obtain the following result.

Figure 11:
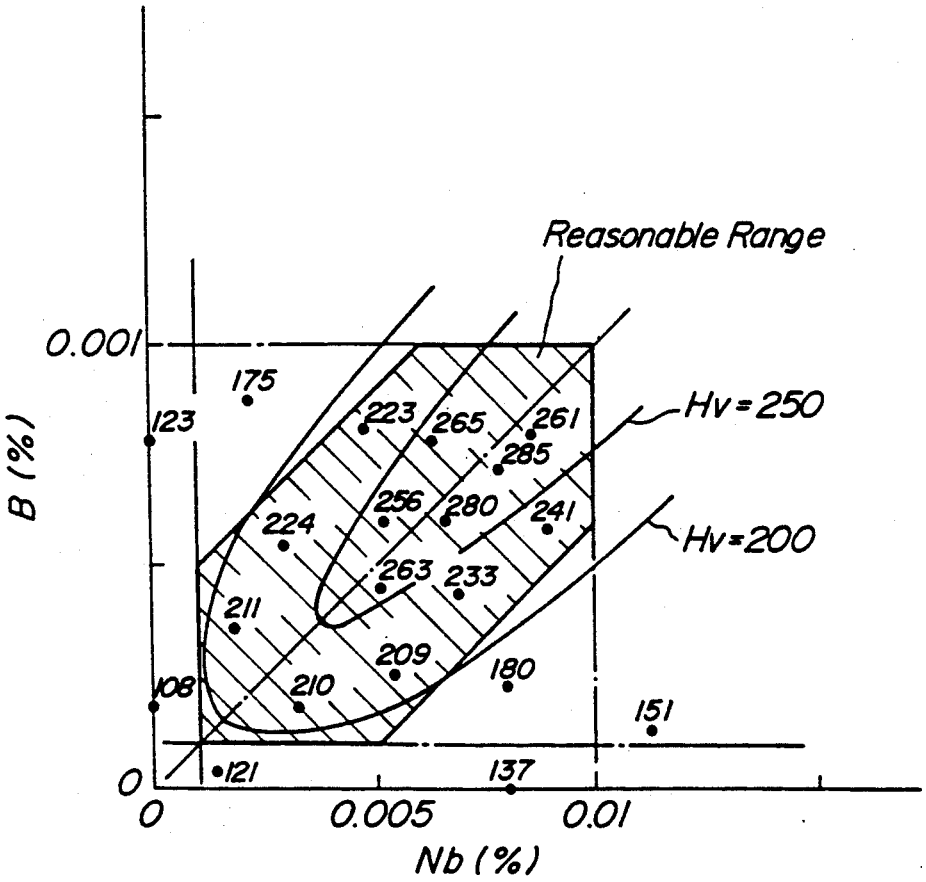
FIG. 11 is a relation between addition amount of Nb and B and hardness of spot weld portion.

FIG. 11 shows a relation between addition amount of Nb and B, and hardness of spot weld portion (nugget zone).

As a test steel, there was used a steel having a sheet gauge of 0.8 mm and a chemical composition based on C: 0.0015~0.0040%, Mn: 0.13~0.033%, S: 0.008~0.025%, P: 0.011~0.018%, Al: 0.022~0.035%, N: 0.0011~0.0033% and Ti: 0.015~0.037% and varying amounts of B and Nb within ranges of 0~0.0010% and 0~0.011%. The spot welding conditions were the same as in FIG. 1.

As seen from FIG. 11, the hardness of the weld portion (nugget zone) is large at Nb: 0.001~0.010% and B: 0.0001~0.0010%, and particularly the better result is obtained when Nb and B satisfy the above ranges and the B amount is within a range of (11/93)Nb±0.0004(%).

The above result shows that the hardness of the spot weld portion is maximum when B and Nb are existent in approximately equal atomic numbers, and suggests a possibility that there is some interaction between Nb and B in steel. At the present, it can not be decided whether or not this is a direct interaction between substitution type solute atom and intersticial solute atom at, for example, solid solution state.

Moreover, the change of properties of base metal by the combined addition of Ti, Nb and B is also considered to result from the above interaction between Nb and B. That is, it is considered that the above interaction makes the crystal grain size of the hot rolled sheet fine and the crystal grain size of the annealed sheet relatively fine to increase Y.S. and the same time the fine homogenization of grain size of the hot rolled sheet brings about the improvement of r-value and El.

Ti:

Ti is not only useful for fixing solute components such as N, S, C and the like, but also exhibits a great effect for the improvement of mechanical properties by the formation of precipitate with these elements.

The improving effect of spot weldability through Nb and B is not realized in the absence of Ti as previously shown in FIG. 5. Because it is required to fix a greater part of elements such as N, C and the like in steel, which fix Nb or B as a precipitate, with Ti for causing the sufficient interaction between Nb and B. Therefore, if it is not particularly intended to improve the mechanical properties through the precipitation distribution, Ti is necessary to be added in an amount of not less than C+N (atomic number) or Ti>(48/12·C+48/14·N). Furthermore, when Ti is added in an amount of less than 0.01% as an absolute amount, the fixation of the solute element is insufficient and the addition effect of Nb and B is not satisfactorily developed.

As to the deep drawability, the high r-value and El are obtained at Ti≧0.01%, but the excessive addition of Ti brings about the extreme softening based on the C fixation, which badly affects the effect of the invention. Therefore, the upper limit is 0.04%. Moreover, the presence of the reasonable Ti amount has an effect of restraining the occurrence of fine precipitate containing Nb, so that the coiling temperature after the hot rolling is not necessary to be high (>600° C.) as in the usual Nb addition, which is advantageous in economy, and the excessive softening due to the growth of crystal grain can be prevented.

As mentioned above, Ti is added in an amount of 0.01~0.04%, preferably Ti/(48/12·C+48/14·N)>1. In order to obtain the above effect at maximum, it is more advantageous to limit the Ti amount added to a minimum.

Figure 13:
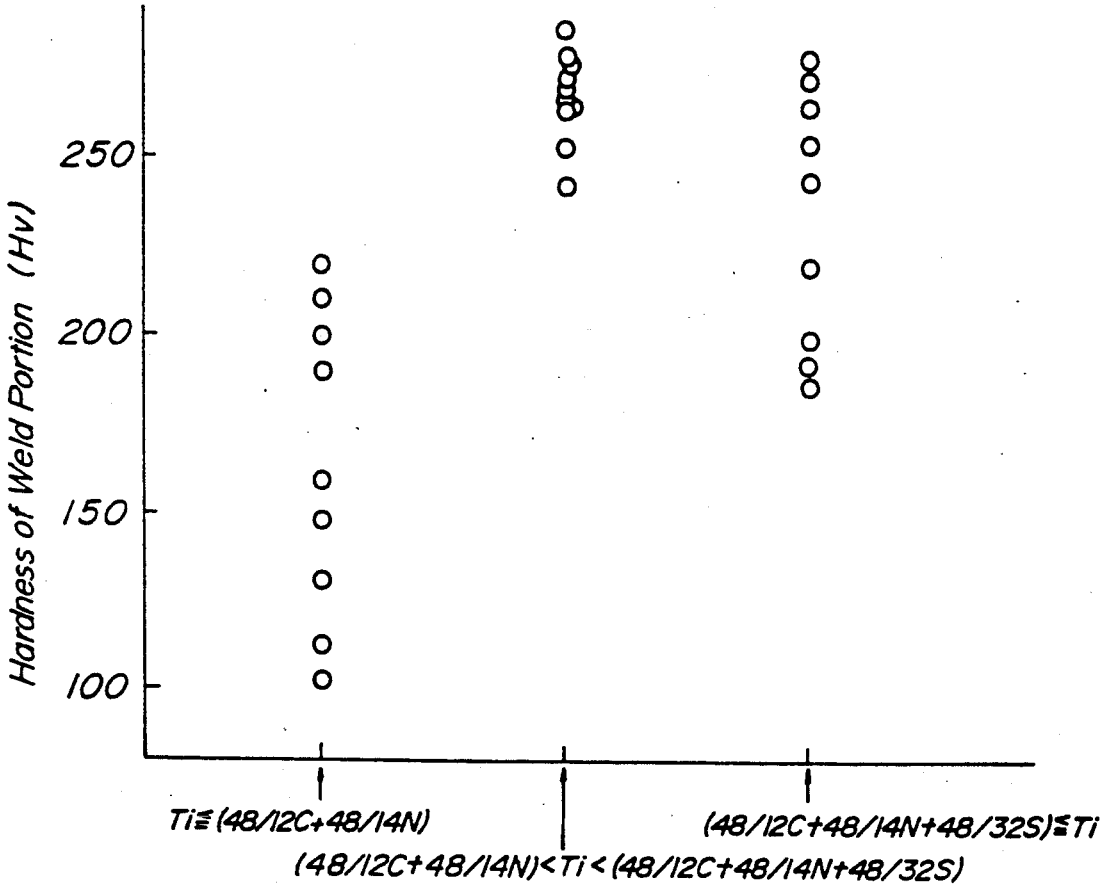
FIG. 13 is a graph showing an influence of Ti amount upon hardness of weld portion.

In FIG. 13 are shown results examined on the influence of Ti amount upon the hardness of the weld portion over a wide composition range. The chemical composition and welding conditions are the same as in the case of FIG. 11.

As seen from FIG. 13, the data of the hardness are roughly divided into three parts in accordance with the range of the Ti amount. That is, in case of Ti≦(48/12·C+48/14·N), the weld portion exhibits a high hardness or a very low hardness, so that the scattering of the hardness is large. This is considered due to the fact that the Ti amount is less so that the yield of B lowers and the interaction effect between Nb and B is insufficient. On the other hand, in case of Ti>(48/12·C+48/14·N), the hardness is Hv≧180 at minimum. Furthermore, it has been confirmed that the high level when Ti<(48/12·C+48/14·N+48/32·S). This shows that when Ti is added in a necessary minimum amount or an amount of not less than equivalent to C and N, the sufficient hardness is obtained but when the Ti addition amount is more than equivalent to S, the hardness of the weld portion tends to rather lower. Because, it is considered that when Ti is existent in a sufficient (excessive) amount to C, N and S, the effect of Nb forming a precipitate with a part of C is substantially lost.

According to the invention, therefore, the expected effect is obtained by limiting the Ti amount to Ti>(48/12·C+48/14·N), but in order to provide a more excellent effect, it is preferable to limit the Ti amount to a narrower range of Ti<(48/12·C+48/14·N+48/32·S) in balance with C, N and S.

Figure 14:
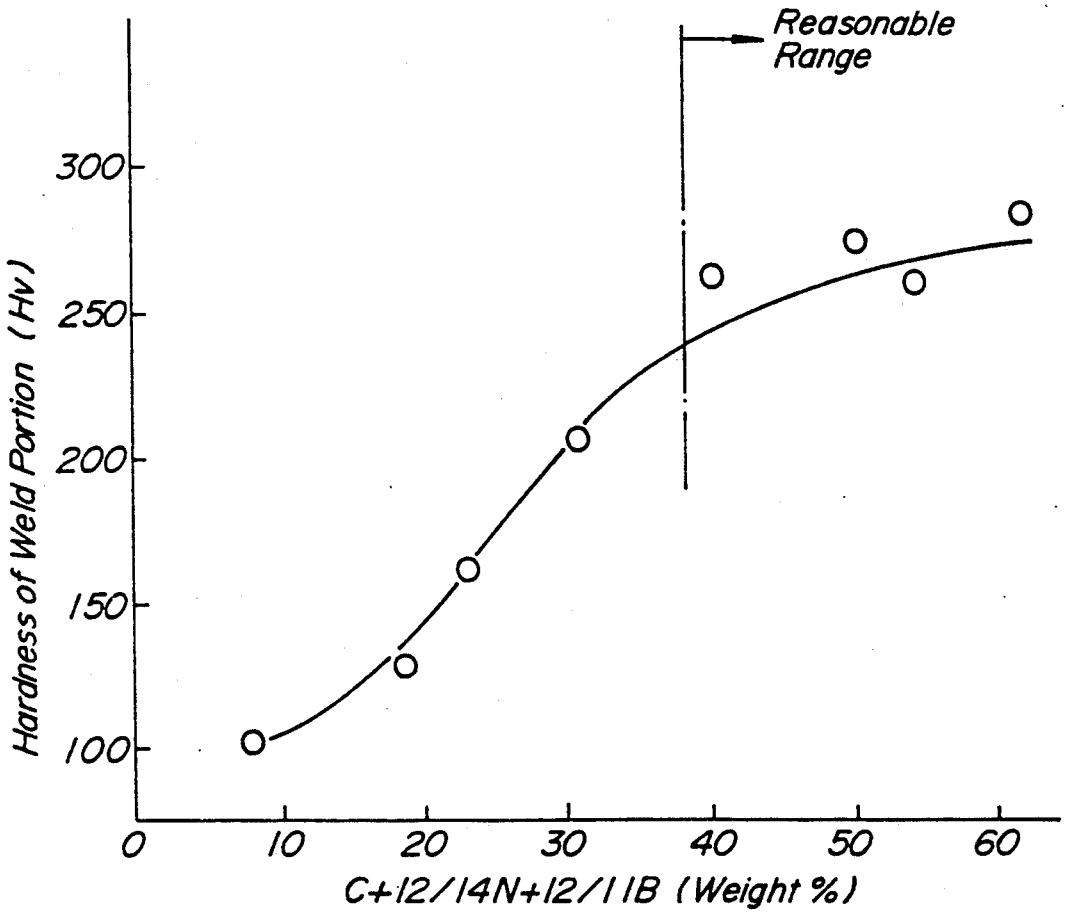
FIG. 14 is a graph showing an influence of C, N and B upon hardness of weld portion.

Moreover, in case of utilizing no fine Ti precipitate, even when Ti, Nb and B are added, if the amounts of C, N and B are too small, the hardening of the weld portion is insufficient. FIG. 14 shows results examined on the influence of C, N and B as an intersticial solute element upon the hardness of the weld portion in various steels, wherein C+12/14·N+12/11·B is plotted on an abscissa for converting the amount of all elements into C amount.

As seen from FIG. 14, when C+12/14·N+12/11·B is not more than 38 ppm, the effect of forming the fine structure is insufficient and the sufficient hardness of the weld portion is not obtained. According to the invention, therefore, C, N and B are added so as to satisfy C+12/14·N+12/11·B>38 ppm.

Although the necessary components according to the invention are within the aforementioned ranges, it is very effective to disperse the fine Ti precipitate having a grain size of not more than 0.05 μm into steel in the predetermined amount as mentioned above in order to satisfactorily achieve the object aiming at the invention.

As mentioned above, the amount of fine Ti precipitate in steel is limited to not less than 30 ppm as a Ti conversion amount in order to effectively obtain the ΔY.P. raising. Furthermore, the reason why the grain size of Ti precipitate is limited to not more than 0.05 μm is due to the fact that when the grain size exceeds 0.05 μm, even if the amount of the Ti precipitate increases, the weldability and the strength and toughness of the weld portion can not be improved to an expected extent.

According to the invention, the advantageous effect is also produced by controlling the surface properties of the steel sheet, which is proved from the following experimental results.

As a test steel, there were used cold rolled sheets of a low carbon steel sheet and an extra-low carbon steel each having a chemical composition shown in the following Table 2.

TABLE 2

| | C | Si | Mn | P | S | Ti | Nb | B | Al | N |
|---|---|---|---|---|---|---|---|---|---|---|
| Low carbon steel | 0.04 | 0.02 | 0.15 | 0.012 | 0.009 | 0.020 | 0.004 | 0.0003 | 0.04 | 0.0020 |
| Extra-low carbon steel | 0.002 | 0.02 | 0.14 | 0.014 | 0.011 | 0.017 | 0.006 | 0.0005 | 0.07 | 0.0013 |

Each of these cold rolled steel sheets was subjected to a skin pass rolling at a reduction of 0.8% with a skin pass roll dulled at its surface by a laser. In this case, the surface roughness pattern of the steel sheet after the skin pass rolling was changed by varying conditions in the laser dulling process. Then, a specimen of 30×30 mm was cut out from each of the sheets and subjected to a spot welding.

Figure 17:
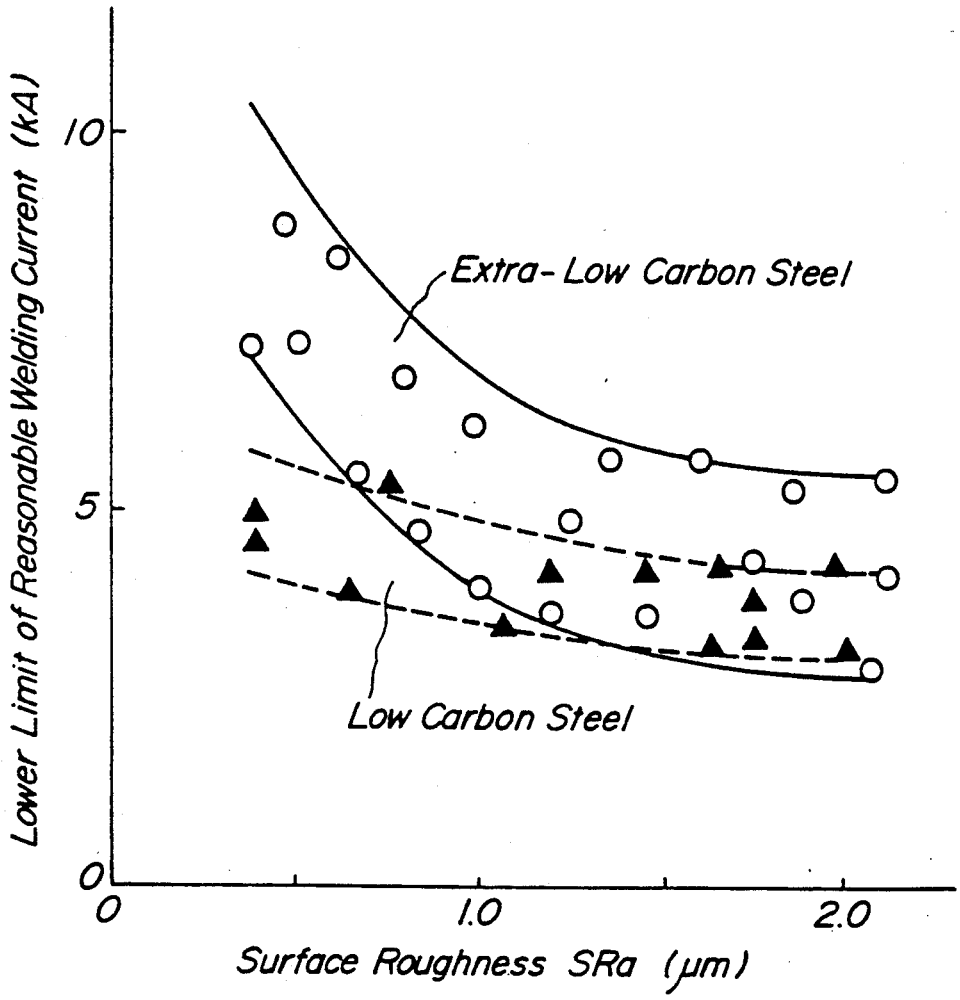
FIG. 17 is a graph showing a relation between surface roughness SRa of steel sheet and lower limit of reasonable welding current in the spot welding.

FIG. 17 shows a relation between lower limit of weldable current and surface roughness (SRa) in the spot welding. The spot welding conditions were a sheet gauge of 0.7 mm, a welding time of 7 cycles, an applied pressure of 175 kgf, and a cap diameter of 4.0 mm. Moreover, the surface roughness SRa is a center-face average roughness (unit: μm) and is represented by the following equation:

$$SRa = \frac{1}{S_M} \int_0^{L_x} \int_0^{L_y} |f(X,Y)| \, dX dY$$

when a portion of area $S_M$ is taken out from the rough curved surface at its center face and X-axis and Y-axis of orthogonal coordinate is placed on the center face of this portion and an axis perpendicular to the center face is Z-axis to express the rough curved surface by $Z=f(X,Y)$, provided that $L_X \cdot L_Y = S_M$.

As seen from FIG. 17, the lower limit of weldable current lowers with the increase of SRa, and when SRa=2.0 μm, the lower limit of weldable current in the extra-low carbon steel becomes approximately equal to that of the low carbon steel.

The reason on the lowering of the lower limit of weldable current with the increase of SRa is considered as follows. That is, as the surface roughness becomes large, the contact area in the welding becomes small. If the same current is applied, the smaller the contact area, the larger the electric resistance, so that the heat generating amount increases. Therefore, as the surface roughness becomes larger, the current value for obtaining the same heat generating amount may be made small.

It has been found out that the spot weldability of the extra-low carbon steel is dependent upon the surface roughness SRa as mentioned above. Further, it has been elucidated from results of many experiments that the spot weldability is strongly dependent upon Y.S.

In this connection, the inventors have made the experiment by changing SRa and Y.S. over wide ranges.

Figure 18:
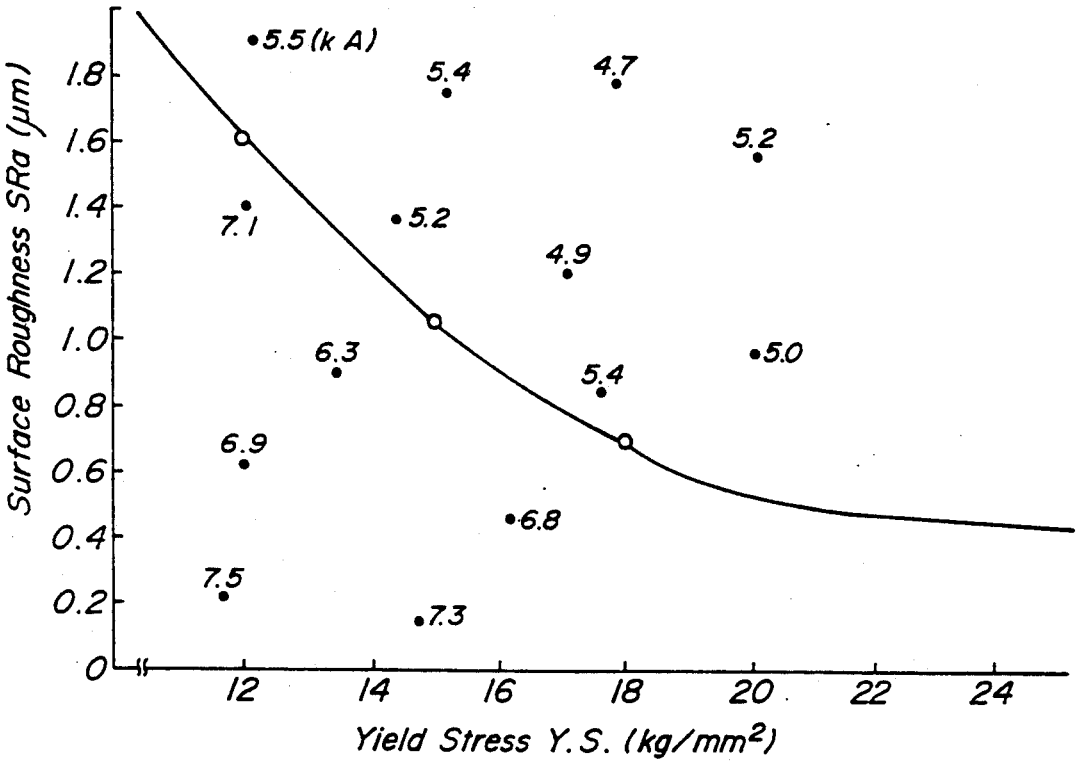
FIG. 18 is a graph showing influences of surface roughness SRa and yield stress Y.S. of steel sheet upon lower limit of reasonable welding current.

In FIG. 18 are shown results measured on the limit value of weldable current by changing SRa and Y.S. when using the extra-low carbon steel of FIG. 17. The spot welding conditions were a specimen size of 0.8×30×30 mm, a CF type electrode of 4.5 mm in diameter, an applied pressure of 190 kgf, a welding time of 8 cycles, and a welding current of 7.5 kA. Moreover, numerals in FIG. 18 indicate a lower limit of weldable current at each point, respectively.

As seen from FIG. 18, when SRa satisfies SRa≧32.-4/Y.S.−1.1, the lower limit of weldable current approximately equal to that of the low carbon steel is obtained.

Although the reason why the lower limit of weldable current shifts toward low SRa side as Y.S. becomes higher is not necessarily clear, the following is considered at the present. That is, when SRa is same, as Y.S. becomes higher, the deformation under pressure is small and consequently the contact area in the welding becomes small, the electric resistance rises and the heat generating amount increases. Therefore, as Y.S. becomes higher, the lower limit of weldable current shifts up to a low SRa side.

As mentioned above, when SRa is adjusted in such a manner that SRa and Y.S. satisfy the above relationship, good formability and spot weldability are obtained. According to the inventors' studies, it has been confirmed that the object aimed at the invention is further achieved by defining area ratio of convex portions on the steel sheet surface SSr and an average surface ratio per one of convex portions SGr within predetermined ranges.

Figure 19:
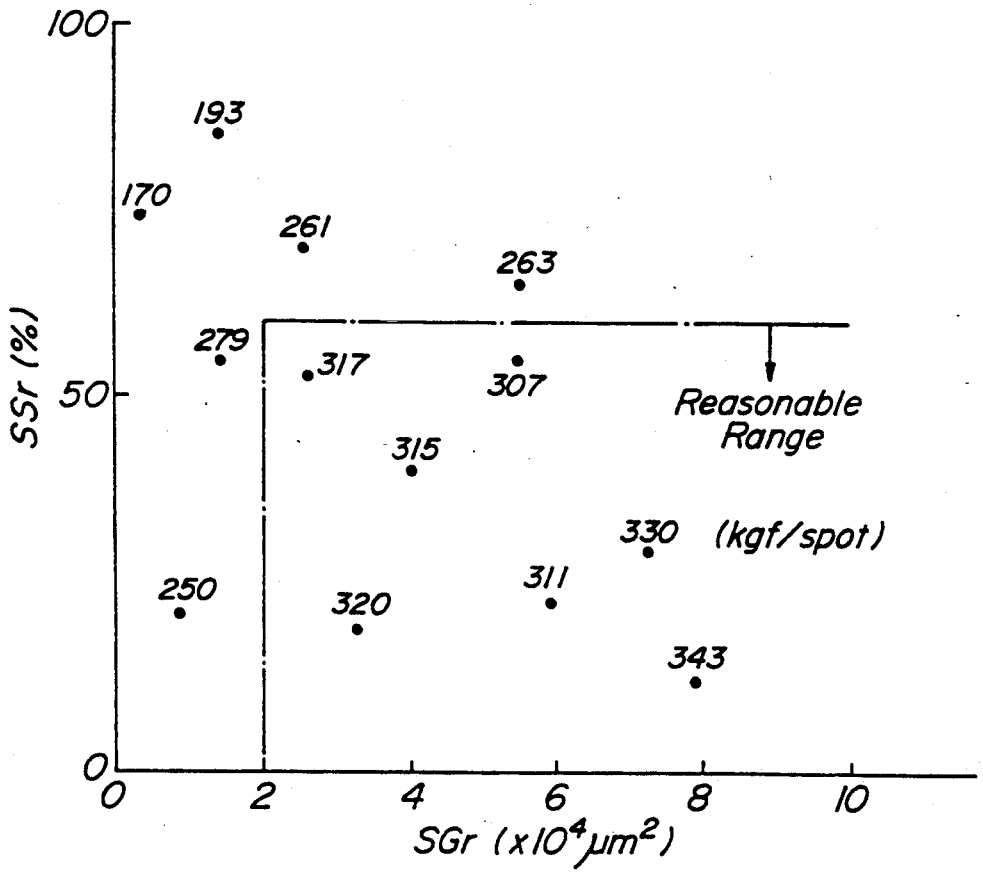
FIG. 19 is a graph showing a relation between area ratio of convex portions SSr and average area per one convex portion SGr exerting on cross tensile strength after spot welding.
Figure 20:
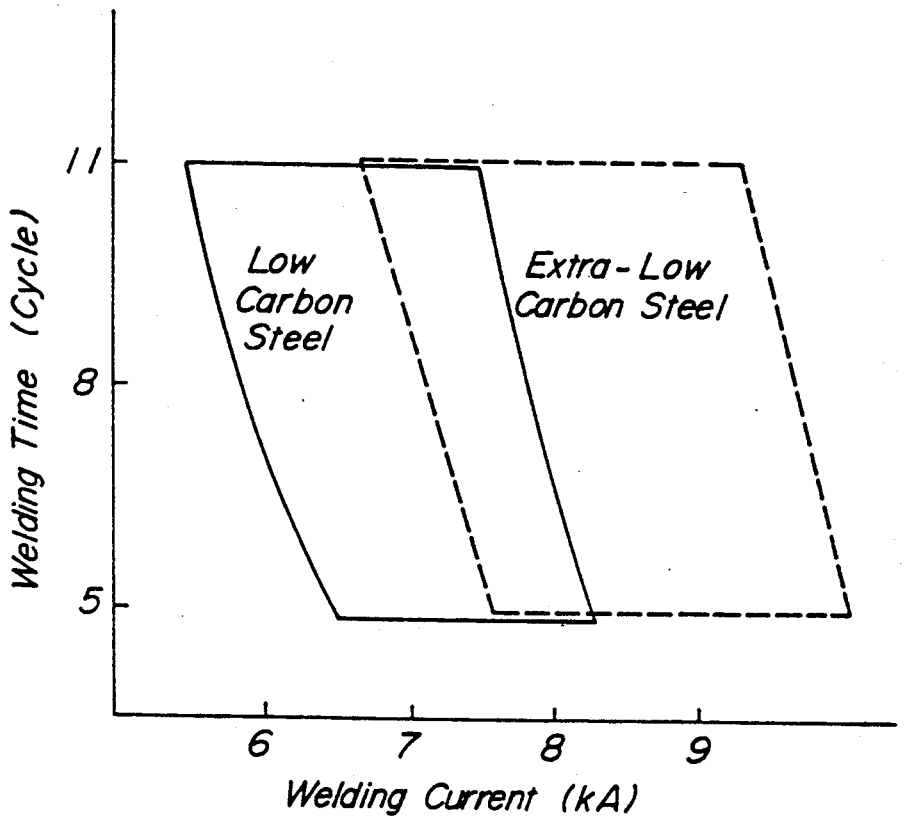
FIG. 20 is a graph showing reasonable welding conditions in the conventional low carbon steel and the extra-low carbon steel.
Figure 21:
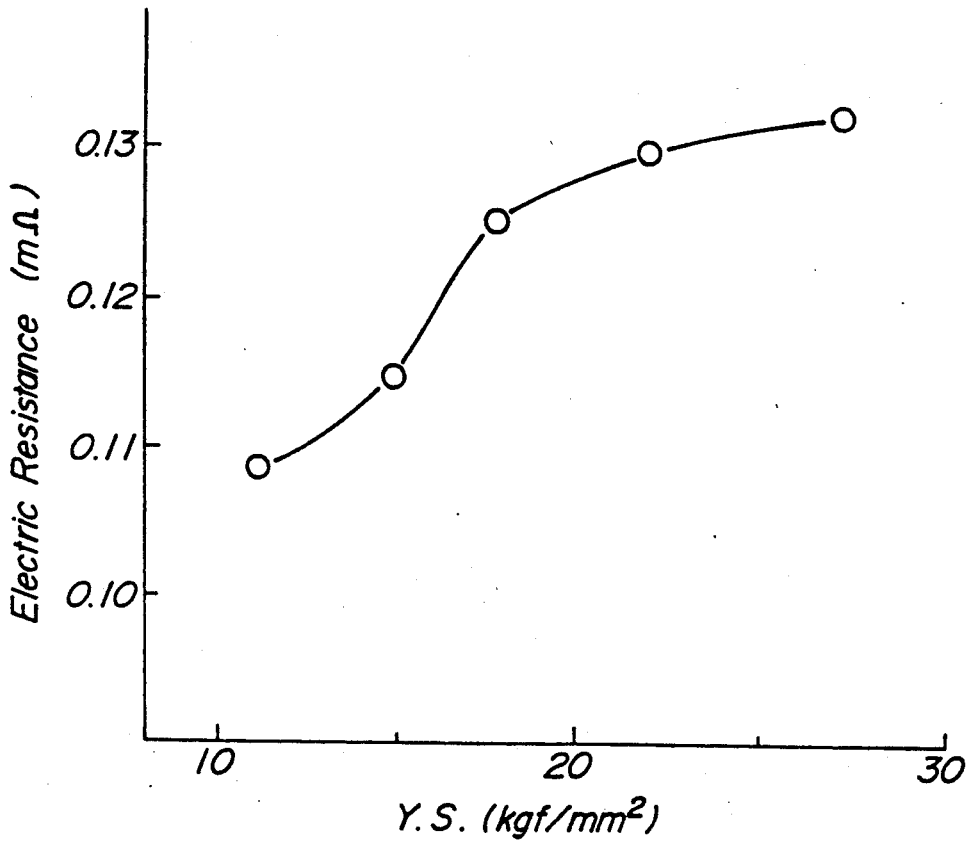
FIG. 21 is a graph showing a relation between Y.S. and electric resistance in steel sheet.

In FIG. 19 are shown results examined on a relation between area ratio of convex portions (SSr) and average area per one convex portion (SGr) exerting on cross tensile strength after the spot welding of the extra-low carbon steel used in FIGS. 17 and 18.

As a specimen for cross tensile test, there was used a specimen of 0.8 mm in sheet gauge according to JIS Z3137. The spot welding conditions were a welding time of 8 cycles, an applied pressure of 175 kgf, and a welding current of 7.5 kA. The area ratio of convex portions (SSr) and average area per one convex portion (SGr) were measured by means of a three-dimensional surface roughness meter. The numerical value in FIG. 19 is a shearing tensile force of spot weld portion at each point.

As seen from FIG. 19, when SSr≦60% and SGr≧$2\times10^4$ $\mu m^2$, the shearing tensile force is not less than 300 kgf/spot and the strength is considerably increased.

The reason on the existence of the above reasonable range as to the strength of weld portion is considered due to the following fact. That is, the lower the area ratio of convex portions, the smaller the contact area, so that the electric resistance in the welding increases to lower the welding current value. On the other hand, however, the strength after the welding lowers as the area ratio of convex portions becomes small. Therefore, in order to compensate the strength after the welding, it is considered that a minimum line is existent in the average area per one convex portion as the area ratio of convex portions is low.

The inventors have made studies based on the above fundamental data and found out that cold rolled steel sheets having improved formability and spot weldability are obtained by controlling the surface state of the sheet as mentioned later.

In a first preferable embodiment, SRa is desirable to be SRa≧32.4/Y.S.−1.1. If SRa<32.4/Y.S.−1.1, the spot weldability based on the surface control is not observed.

In a second preferable embodiment, SSr and SGr are desirable to be SSr≦60% and SGr≧$2\times10^4$ $\mu m^2$. If SSr>60% or SGr<$2\times10^4$ $\mu m^2$, the improved spot weldability based on the surface control can not be obtained.

Moreover, it is naturally possible to develop the desired effect by each of the requirements on the steel composition, particularly balance of Ti-Nb-B, Ti precipitate and surface roughness alone. Since the conditions satisfying each of these requirements are not contrary to each other, the greater effect can be obtained by combining these requirements without any troubles. For instance, the surface roughness can be adjusted in order to more advantageously provide the reasonable welding range of the steel sheet containing finely distributed Ti precipitates. That is, it is desirable to simultaneously satisfy the above requirements in order to obtain the best spot weldability.

The reason on the limitation of production conditions according to the invention will be described in detail below.

The cooling rate in the solidification and cooling stage of steel is particularly important for obtaining fine Ti precipitates. That is, it is necessary to cool the steel at a cooling rate of not less than 3.0° C./min within a temperature range of 1,300° C. to 1,000° C.

Figure 7:
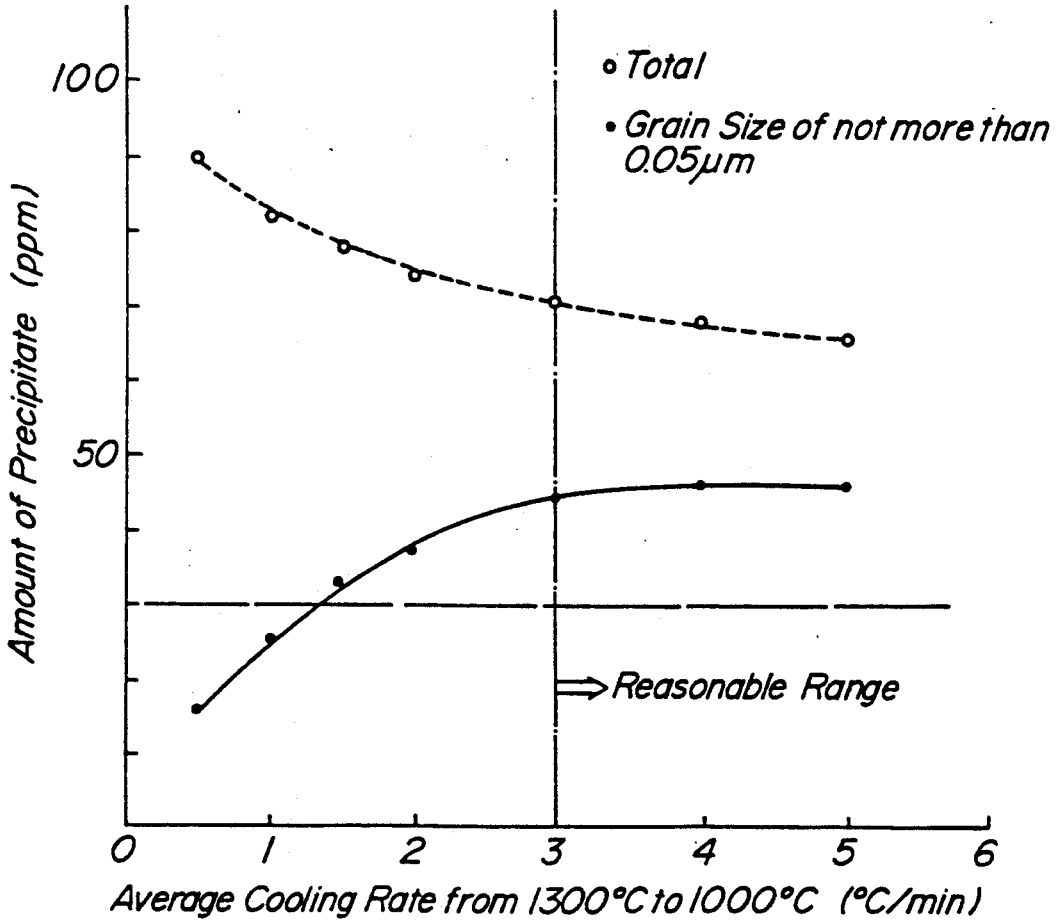
FIG. 7 is a graph showing a relation among slab cooling rate from 1,300° C. to 1,000° C., total amount of Ti precipitate and amount of fine precipitate.

In FIG. 7 are shown quantitatively analyzed results on the amount of Ti precipitate having a grain size of not more than 0.05 μm and the total amount of Ti precipitates when the cooling over a temperature range of 1,300° C. to 1,000° C. at the casting stage is carried out by varying the cooling rate within a range of 0.5° C./min to 5° C./min.

As seen from FIG. 7, the total amount of Ti precipitates reduces with the increase of the cooling rate, while the amount of Ti precipitate having a grain size of not more than 0.05 μm inversely increases. Particularly, when the cooling rate is not less than 3.0° C./min, the fine Ti precipitate having a grain size of not more than 0.05 μm is stably precipitated in a great amount.

Moreover, such a cooling rate can not be attained even in the ingot making process as well as the usual continuous casting process, so that it is necessary to take any means such as forced cooling, control of slab thickness or the like in order to ensure the given cooling rate. This is not necessary in another method according to the invention as mentioned later.

Then, the slab cooled at the above cooling rate is heated at subsequent slab heating stage, but in this case, it is required to heat the slab at a relatively low temperature of not higher than 1,200° C. for preventing the coarsening of Ti precipitate.

Figure 8:
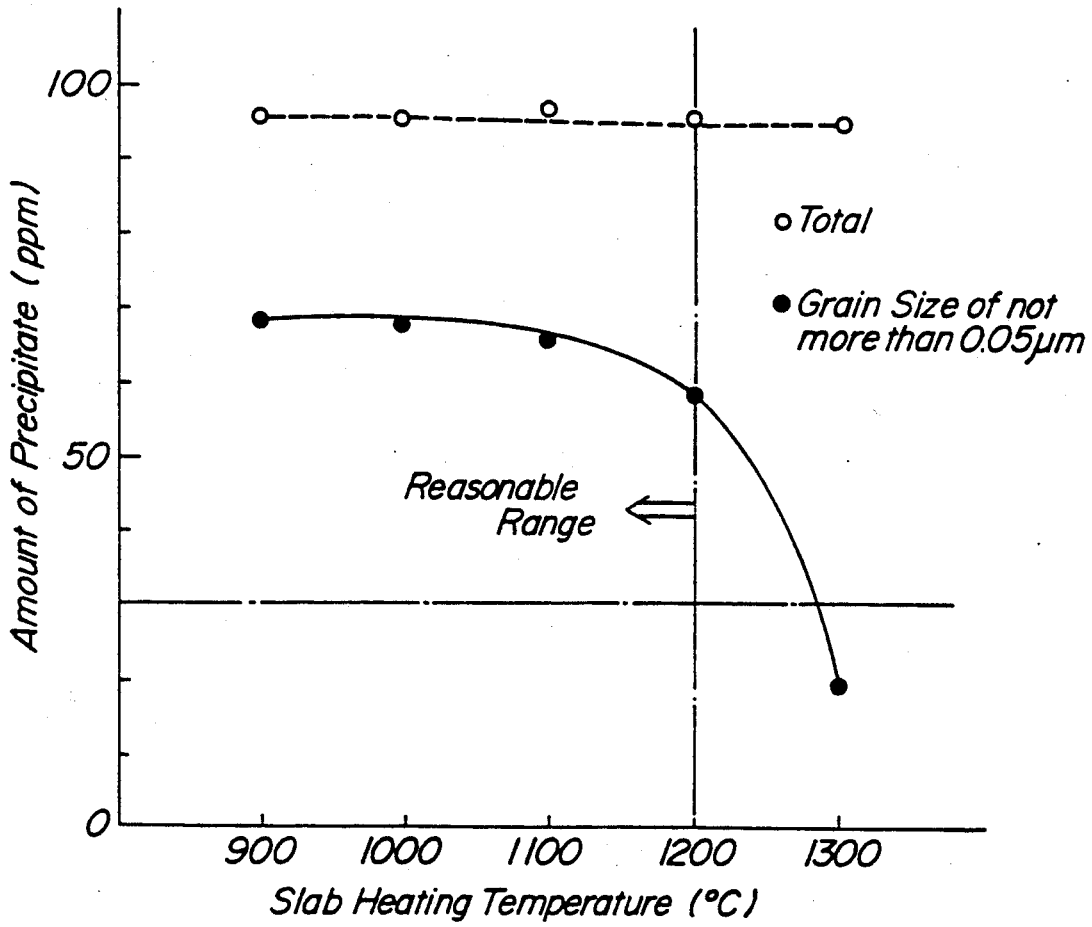
FIG. 8 is a graph showing a relation among slab heating temperature, total amount of Ti precipitates and amount of fine precipitate.

In FIG. 8 are shown results examined on a relation among slab heating temperature, total amount of Ti precipitates and amount of fine precipitate having a As seen from FIG. 8, when the slab heating temperature exceeds 1,200° C., the amount of fine Ti precipitate rapidly reduces due to Ostwald's growth of Ti precipitate, so that the slab heating is carried out at a temperature of not higher than 1,200° C. in the invention.

On the other hand, when Y.S. is increased irrespective of Ti precipitate or when it is difficult to perform the quenching of the slab, it is important that the properties such as r-value, El and the like are not degraded. In the Ti-Nb B addition system, therefore, the restriction of conditions at hot rolling-cold rolling step as mentioned below is required in order to ensure good properties. That is, it is necessary that the slab is subjected to a finish rolling at 700°~900° C. and further to a coiling in a temperature range of 300°~600° C. in the hot rolling of the steel slab.

The lower limit of the finish temperature is determined from a viewpoint of suppressing the degradation of r-value due to residual strain, while the upper limit thereof is determined from a viewpoint of preventing the degradation of r-value due to the coarsening of crystal grain.

On the other hand, when the coiling temperature is too high, the improving effect of the weldability with the coexistence of Nb and B becomes considerably weak, so that the upper limit of the coiling temperature is 600° C. When the coiling temperature is too low, troubles are caused at subsequent steps, so that the lower limit is 300° C.

The cold rolling is to impart an adequate cold strain required in the formation of recrystallization texture. Therefore, the lower limit of the reduction is 60% so as to provide a sufficient rolling strain. On the other hand, when the reduction is too high, the loading of the rolling machine becomes large and the productivity lowers, so that the upper limit is 85%.

Moreover, the annealing temperature is required to be not lower than the recrystallization temperature. However, when the annealing temperature is too high, the steel is excessively softened and the effect aiming at the invention can not be obtained, so that the upper limit is 780° C. On the other hand, when the fine Ti precipitates are existent in a great amount, the recrystallization temperature and the softening temperature shift toward high temperature side, so that the continuous annealing temperature is shifted to 700°~900° C. In the latter case, the lower limit of 700° C. is required to obtain a recrystallization texture, while the upper limit of 900° C. is required to prevent the excessive softening of the steel sheet and the coarsening of Ti precipitate.

Figure 15:
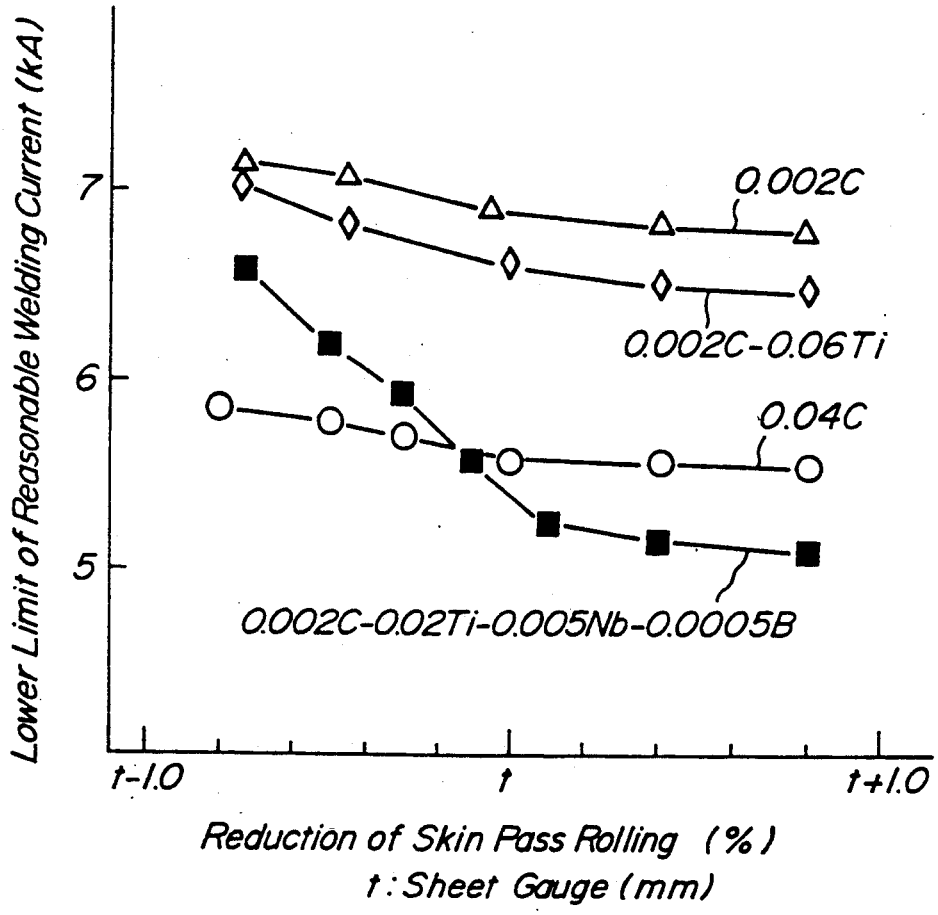
FIG. 15 is a graph showing a relation between reduction of skin pass rolling and lower limit of reasonable welding current.

According to the invention, when the fine Ti precipitates are dispersed into the steel, it is not necessarily required to conduct the skin pass rolling, but the skin pass rolling may be carried out at a usually practised reduction. However, if it is intended to obtain a relatively high Y.S. irrespective of Ti precipitate, the skin pass rolling becomes particularly important. In FIG. 15 are shown results examined on the influence of the reduction of skin pass rolling upon the lower limit of reasonable welding current.

As a test steel, there were used various soft steel sheets for deep drawing of 0.7 mm in gauge and the lower limit of weldable current thereof were measured.

As seen from FIG. 15, the effect by the reduction of skin pass rolling is particularly large in the Ti-Nb-B series steel, and there is recognized a phenomenon that the lower limit of reasonable welding current is lower than that of the low carbon steel when the reduction is not less than (sheet gauge (mm)+0.1)%. Furthermore, the thus obtained steel sheet is excellent in the fatigue properties of spot weld portion.

Then, there was examined the influence of the reduction of skin pass rolling upon the fatigue properties at low cycle. As a test steel, there were used four cold rolled and annealed steel sheets of 0.8 mm in gauge, wherein the steel A was a general low carbon Al killed steel containing 0.04% of C, the steel B was an extra-low carbon steel containing 0.003% of C and no Ti, Nb or the like, and the steel C was an extra-low carbon steel according to the invention containing 0.002% of C, 0.031% of Ti, 0.007% of Nb and 0.0006% of B, and the steel D was the same as in the steel C. However, the steels A C were produced at a reduction of skin pass rolling of 0.3%, while the steel D was produced at a reduction of skin pass rolling of 1.3%.

The welding conditions were a welding time of 8 cycles, a welding current of 7.5 kA and an applied pressure of 200 kgf. Furthermore, the addition mode in the fatigue test was 0-tension or complete cantilevered shearing tensile fatigue. The test was stopped according to JIS Z3136 when the fatigue crack having a length equal to the nugget diameter was observed from the steel sheet surface.

Figure 16:
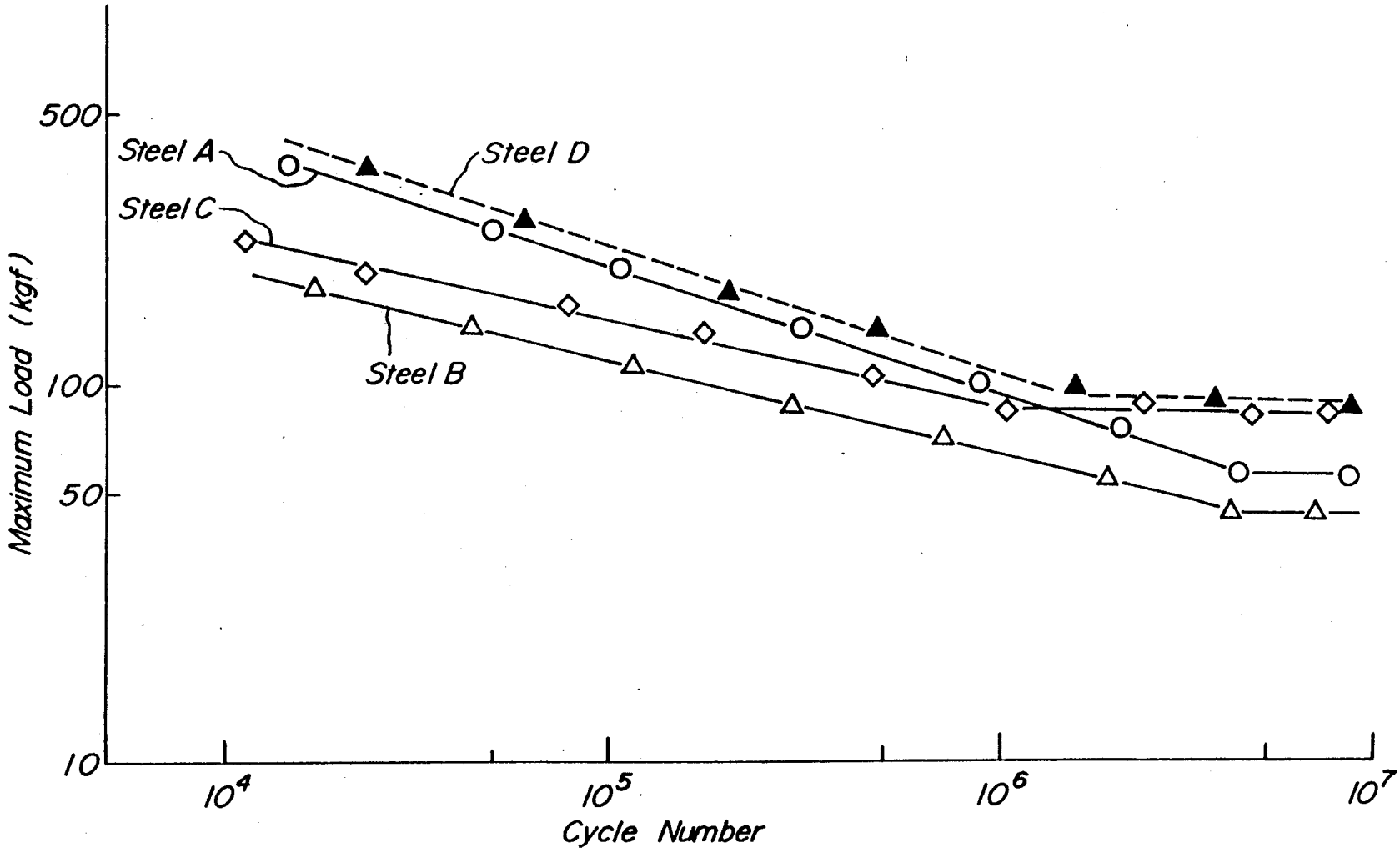
FIG. 16 is a graph showing influences of components in steel and reduction of skin pass rolling upon fatigue strength of spot weld portion.

The measured results are shown in FIG. 16.

As seen from FIG. 16, the fatigue strength of the steel B as an extra low carbon steel is low as compared with that of the steel A as a usual low carbon steel. On the other hand, in the steel C containing Ti-Nb-B subjected to skin pass rolling at a low reduction of 0.3%, the fatigue strength at high cycle region is somewhat improved, but the fatigue strength at low cycle region is still low. On the contrary, in the steel D subjected to skin pass rolling at a high reduction of 1.5%, the fatigue strength is largely improved at not only high cycle region but also low cycle region.

Namely, it has been confirmed that such an effect is obtained when the extra-low carbon steel contains Ti-Nb-B and subjected to skin pass rolling at a high reduction likewise the case of FIG. 15.

According to the invention, it is necessary to conduct the skin pass rolling at a reduction of not less than (sheet gauge (mm)+0.1)%. However, when the reduction is too high, the degradation of mechanical properties is conspicuous, so that the upper limit of the reduction is 3.0%.

Although the reason why the fatigue properties of spot weld portion are effectively improved by subjecting to a skin pass rolling at the reduction as mentioned above is not necessarily clear, it is guessed that the change in the distribution of residual stress in thickness direction at the skin pass rolling has some influence on the improvement of fatigue properties.

Moreover, it is desirable to control the surface of the steel sheet to the aforementioned surface roughness by using a work roll having regulated surface roughness in the skin pass rolling and/or cold rolling.

Although the laser dulling work has been mainly described as a dulling process of the roll, plasma working, discharge working and the like may naturally be utilized. In short, it is important that the surface roughness should be included in the aforementioned reasonable range.

The function and effect of Ti, Nb and B addition on the weld portion are summarized as follows.

At first, Ti is necessary for ensuring the mechanical properties to a certain extent, fixing N and finely dispersing Ti precipitates. Secondary, Nb makes up for the improving effect of mechanical properties through Ti, and has an effect of forming fine structure together with B in addition to the dispersing effect of Ti precipitates. Furthermore, B hardly has an effect of forming the fine structure alone, but exhibits a remarkable effect together with Nb or Ti precipitate.

Since the effect of forming the fine structure under the coexistence of Nb and B is very strong, it is important that the amounts of Nb and B should be restricted to a minimum while taking the balance among these elements.

Although the reason on the effect obtained by the combined addition of Ti-Nb-B is not still clear, it is considered as follows.

In the spot welding, the steel sheet is locally fused and the temperature in the vicinity of the fused portion becomes fairly high. In the extra low carbon steel sheet, therefore, the crystal grains are generally and considerably coarsened. This is a cause that the structure of the conventional extra-low carbon steel is unsound, and a greatest cause that the strength of the weld portion is low.

However, it has been confirmed that the structure in the vicinity of the weld portion is not coarsened but is made fine in the steels according to the invention. This is guessed due to the fact that a pair of Nb and B atoms strongly suppresses the formation and growth of transformation nucleus at $\delta$-$\gamma$ or $\gamma$-$\alpha$ transformation. In this case, the structure of the weld portion is not a regular system but is a needle system, which is a very rare structure as the extra-low carbon steel.

The greatest feature of the invention lies in a point that the above effect of forming the fine structure is obtained without causing the degradation of the mechanical properties.

Furthermore, the presence of fine Ti precipitate propels the occurrence of crystal grain nucleus for the $\gamma$-formation at the heating state of the spot welding and suppresses the growth of the grains at subsequent step. Even at the cooling, the coarsening of the $\gamma$-grains is suppressed by the fine Ti precipitate dispersed into steel, and also the fine and dense structure of the weld portion is obtained by the Ti precipitate and the combined addition of Nb and B in the transformation at the cooling. Thus, the excellent low-temperature roughness of the weld portion can be obtained while holding the strength at a level equal to that of the base metal.

Moreover, steel sheets additionally added with Ti, Nb or B for the purpose of improving the deep drawability, secondary work brittleness and the like and methods thereof are proposed in Japanese Patent Application Publication No. 60-47,328, Japanese Patent laid open Nos. 59-74,232, 59-190,332, 59-193,221, 61-133,323 and the like. All of these conventional techniques are to provide a good deep drawability by utilizing the function and effect of each of Ti, Nb and B, from which the improving effect of the spot weldability most importantly aiming at the invention and further the fatigue properties of the weld portion can not completely be expected.

For example, in each of the above articles, B is added for improving only the bake hardnenability and secondary workability, while Nb is added for restraining the ageability at room temperature and Ti is mainly added for improving the mechanical properties. Therefore, the addition effects of these elements are simply additional as a principle. Moreover, the restrict condition of $Ti+Nb<0.04\%$ disclosed in Japanese Patent laid open Nos. 59-74,232 and 61-133,323 or $Ti+Nb<0.06\%$ disclosed in Japanese Patent laid open Nos. 59-190,332 and 59-193,221 is to merely give the good phosphatability to the steel sheet. Therefore, the technical idea of Ti-Nb-B combined addition considering the interaction among these elements for the achievement of improved spot weldability aiming at the invention can not completely be found in the above conventional techniques. Of course, these conventional techniques disclose only the steels having a chemical composition different from the composition defined in the present invention [B: 0.0001~0.0010%, Nb: 0.001~0.010%, Ti: 0.01~0.04%, and B: (11/93)Nb-0.0004~(11/93)Nb+0.0004%, Ti/(48/12·C+48/14·N)>1, Nb<1/5·(93/48)Ti] and do not utterly disclose the improvement of spot weldability by the control of distribution state of Ti precipitate or the control of the surface roughness as in the invention at all. This is more clear from the Examples disclosed in these conventional techniques. And also, it is apparent that the Ti amounts claimed in the above conventional techniques, Ti<48/14·N and Ti<48/12·C+48/14·N do not completely satisfy the requirement defined in the invention.

It is needless to say that the conditions in the production of the steel sheet disclosed in the conventional techniques are entirely different from those of the invention because the properties and chemical composition of the steel sheet are different from those of the invention as mentioned above. As to the coiling temperature, however, Japanese Patent laid open No. 59-74,232 discloses that the coiling temperature of not lower than 650° C. is necessary, while Japanese Patent Application Publication No. 60-47,328 and Japanese Patent laid open Nos. 59-190,332, 59-193,221 and 61-133,323 propose the coiling temperature of higher than 600° C. It is well-known that when the coiling temperature is made higher as mentioned above, the mechanical properties are improved to a certain extent, but various problems such as degradations of descaling property and surface properties and the like are caused. On the other hand, the invention is to improve these problems when using such a high coiling temperature disclosed in these conventional techniques.

The following examples are given in the illustration of the invention and are not intended as limitations thereof.

EXAMPLE 1

A molten steel having a chemical composition shown in the following Table 3 was continuously cast to form a cast slab. The resulting slab was cooled at a cooling rate of 0.5°~5° C./min over a temperature range of 1,300°~1,000° C. to produce various slabs having different grain sizes of Ti precipitate.

TABLE 3

| C | Si | Mn | P | S | N | Ti | Nb | B | Al |
|---|---|---|---|---|---|---|---|---|---|
| 0.0025 | 0.01 | 0.13 | 0.010 | 0.009 | 0.0027 | 0.012 | 0.007 | 0.0009 | 0.021 |

Then, each of the slabs was heated to 1,150° C., which was subjected to a hot rolling, a cold rolling and further a continuous annealing at a temperature of 770° C.

In all of the cold rolled sheets cooled at a cooling rate of not less than 3.0° C./min over the temperature range of 1,300°~1,000° C. at the cooling stage of the slab, the Ti precipitates having a grain size of not more than 0.05 μm were dispersed into steel in an amount of not less than 30 ppm as a Ti conversion amount.

Figure 9:
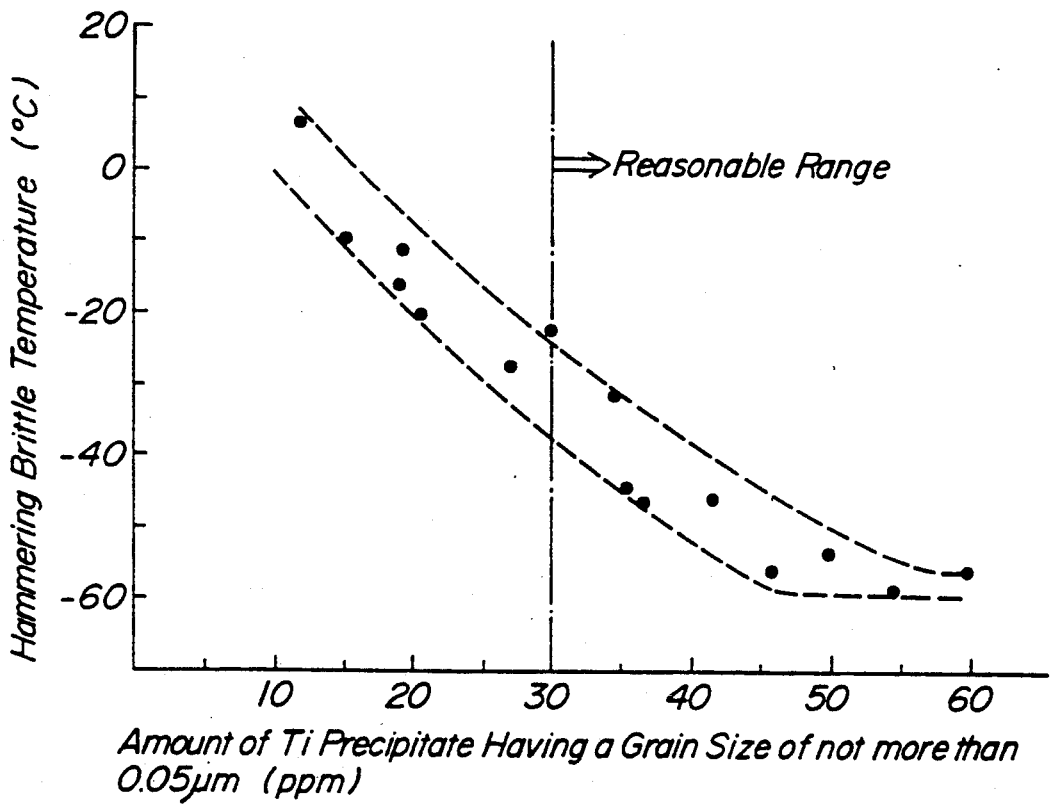
FIG. 9 is a graph showing a relation between amount of Ti precipitate having a grain size of not more than 0.05 pm as Ti conversion amount and hammering brittle temperature.

After each of the above cold rolled sheets was subjected to a spot welding under the same conditions, the change of brittle temperature was measured by a hammering test using a chisel to obtain results as shown in FIG. 9 as a relation to the Ti conversion amount in the Ti precipitates having the grain size of not more than 0.05 μm.

As seen from FIG. 9, when the fine Ti precipitates are dispersed into steel in an amount of not less than 30 ppm as Ti conversion amount, the hammering brittle temperature is very low.

Figure 10:
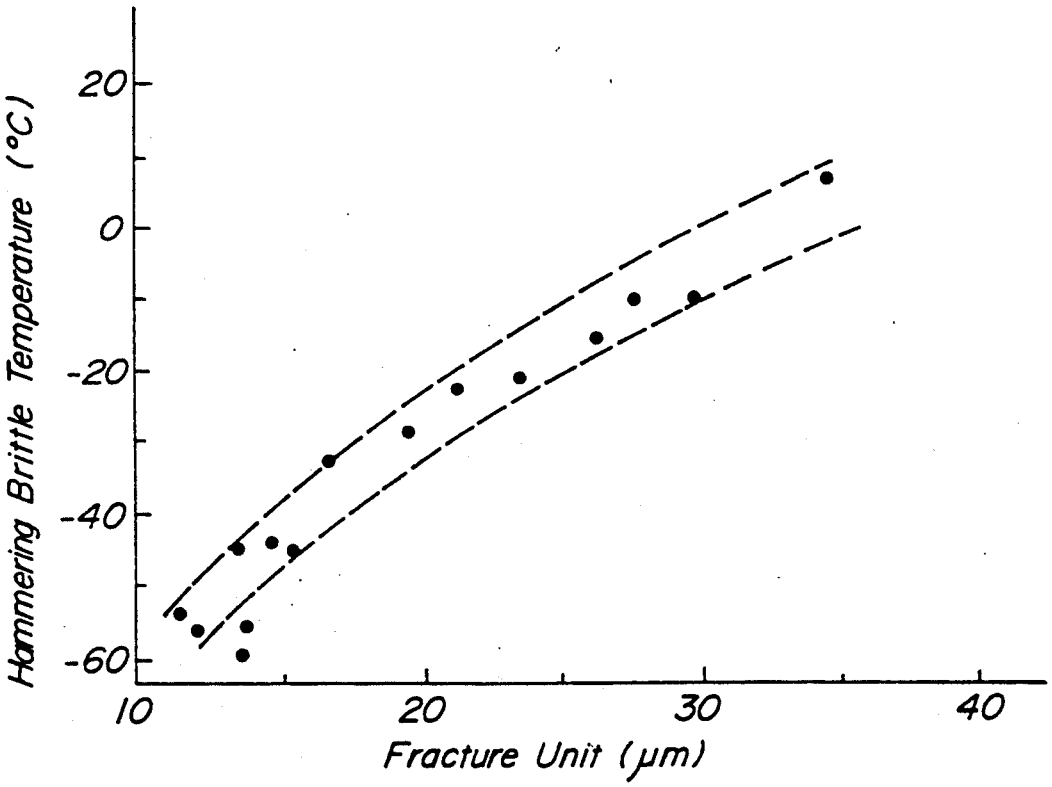
FIG. 10 is a graph showing a relation between fracture unit of brittleness and hammering brittle temperature.

Then, the fracture surface at the hammering test was observed by means of SEM (scanning electron microscope) to obtain a result as shown in FIG. 10 as a relation between fracture unit and hammering brittle temperature.

As seen from FIG. 10, the improvement of low-temperature toughness in the steel according to the invention is considered to be based on the fact that the fracture unit is made small in the formation of the fine structure.

EXAMPLE 2

A molten steel having a chemical composition shown in the following Table 4 was continuously cast to form a cast slab, which was cooled at various cooling rates shown in Table 4 over a temperature range of 1,300°~1,000° C. at the solidification and cooling stage of the slab and then heated to a temperature shown in Table 4. Thereafter, the thus treated slab was subjected to a hot rolling, a cold rolling and further continuous annealing at a temperature of 750°~800° C.

The amount of fine Ti precipitate having a grain size of not more than 0.05 μm as Ti conversion amount and the mechanical properties in the resulting cold rolled sheets were measured to obtain results as shown in Table 4.

Furthermore, the lower limit of reasonable welding current as well as T.S. and vTrs of weld portion when these steel sheets were subjected to a spot welding or a TIG welding were measured to obtain results as shown in the following Table 5.

TABLE 4

| Symbol | | C (ppm) | Si (wt %) | Mn (wt %) | P (wt %) | S (wt %) | Ti (wt %) | Nb (wt %) | B (ppm) | Al (wt %) | N (ppm) | Ti/N (wt %/wt %) |
|---|---|---|---|---|---|---|---|---|---|---|---|---|
| A | Acceptable | 26 | 0.01 | 0.16 | 0.010 | 0.009 | 0.013 | 0.006 | 8 | 0.022 | 26 | 2.3 |
| B | Example | 33 | 0.02 | 0.14 | 0.010 | 0.010 | 0.018 | 0.007 | 7 | 0.024 | 29 | 6.2 |
| C | | 31 | 0.02 | 0.15 | 0.011 | 0.012 | 0.023 | 0.004 | 3 | 0.021 | 34 | 6.8 |
| D | | 24 | 0.01 | 0.15 | 0.011 | 0.008 | 0.031 | 0.006 | 9 | 0.022 | 39 | 7.4 |
| E | Comparative | 22 | 0.02 | 0.16 | 0.011 | 0.007 | 0.008 | 0.007 | 8 | 0.024 | 24 | 3.3 |
| F | Example | 32 | 0.01 | 0.16 | 0.011 | 0.007 | 0.052 | 0.007 | 8 | 0.025 | 38 | 13.7 |
| G | | 31 | 0.01 | 0.16 | 0.010 | 0.009 | 0.021 | 0.021 | 9 | 0.028 | 31 | 6.7 |
| H | | 20 | 0.01 | 0.15 | 0.009 | 0.011 | 0.024 | 0.006 | 18 | 0.025 | 36 | 6.7 |
| I | | 23 | 0.01 | 0.15 | 0.009 | 0.009 | 0.016 | — | 6 | 0.022 | 27 | 5.9 |
| J | | 27 | 0.02 | 0.16 | 0.010 | 0.012 | 0.026 | 0.008 | — | 0.023 | 25 | 10.4 |

TABLE 4-continued

| | | | | | | | | | | | | |
|---|---|---|---|---|---|---|---|---|---|---|---|---|
| K | | 29 | 0.02 | 0.16 | 0.009 | 0.008 | — | 0.007 | 5 | 0.024 | 27 | 0 |
| L | | 230 | 0.01 | 0.15 | 0.009 | 0.008 | 0.033 | 0.007 | 9 | 0.022 | 46 | 7.2 |
| M | Acceptable | 30 | 0.02 | 0.16 | 0.009 | 0.009 | 0.029 | 0.007 | 6 | 0.025 | 32 | 9.1 |
| N | Example | 36 | 0.03 | 0.15 | 0.010 | 0.010 | 0.035 | 0.006 | 9 | 0.026 | 28 | 12.5 |
| O | | 25 | 0.01 | 0.14 | 0.011 | 0.008 | 0.022 | 0.009 | 9 | 0.025 | 24 | 9.2 |
| P | Comparative Example | 29 | 0.02 | 0.15 | 0.010 | 0.009 | 0.023 | 0.006 | 9 | 0.027 | 38 | 6.1 |

| Symbol | | Amount of Ti precipitate (≦0.05 μm) (Ti conversion amount wt %) | Cooling rate (°C./min) | Heating temperature (°C.) | Y.S. (kgf/mm²) | T.S. (kgf/mm²) | El (%) | r |
|---|---|---|---|---|---|---|---|---|
| A | Acceptable | 0.009 | 3.5 | 770 | 19.3 | 30.2 | 51 | 2.2 |
| B | Example | 0.012 | 3.3 | 780 | 21.2 | 30.3 | 50 | 2.1 |
| C | | 0.018 | 3.3 | 775 | 19.1 | 31.2 | 48 | 2.3 |
| D | | 0.021 | 3.6 | 770 | 19.6 | 32.8 | 50 | 2.2 |
| E | Comparative | 0.002 | 3.1 | 780 | 15.3 | 29.1 | 50 | 2.1 |
| F | Example | 0.005 | 3.7 | 785 | 15.5 | 31.9 | 47 | 1.9 |
| G | | 0.014 | 4.1 | 775 | 20.5 | 30.8 | 49 | 2.0 |
| H | | 0.015 | 3.4 | 780 | 19.8 | 31.2 | 48 | 1.8 |
| I | | 0.009 | 3.6 | 785 | 19.5 | 30.3 | 46 | 1.1 |
| J | | 0.013 | 3.7 | 785 | 18.9 | 29.4 | 45 | 2.1 |
| K | | 0 | 3.5 | 770 | 14.6 | 28.3 | 44 | 2.0 |
| L | | 0.021 | 4.2 | 775 | 19.5 | 34.5 | 32 | 1.2 |
| M | Acceptable | 0.006 | 3.5 | 780 | 18.4 | 31.2 | 49 | 2.1 |
| N | Example | 0.007 | 3.9 | 785 | 18.9 | 30.8 | 50 | 2.0 |
| O | | 0.006 | 4.4 | 770 | 17.9 | 31.2 | 48 | 2.0 |
| P | Comparative Example | 0.0025 | 1.5 | 730 | 15.2 | 29.4 | 49 | 1.9 |

TABLE 5

| | | Spot welding | | TIG welding | |
|---|---|---|---|---|---|
| | | Lower limit of reasonable welding current* | Welding strength** | Charpy impact strength of 2 mmV notch vTrs (°C.) | |
| Symbol | | (kA) | (kgf) | WM | Bond |
| A | Acceptable | 6.0 | 400 | −20 | −30 |
| B | | 5.5 | 425 | −25 | −30 |
| C | Example | 6.0 | 400 | −25 | −35 |
| D | | 5.5 | 410 | −30 | −40 |
| E | Comparative | 7.0 | 220 | 0 | 0 |
| F | | 7.0 | 230 | +10 | +5 |
| G | Example | 5.0 | 270 | +5 | 0 |
| H | | 5.5 | 270 | 0 | +5 |
| I | | 5.5 | 280 | −5 | 0 |
| J | | 6.0 | 200 | 0 | 0 |
| K | | 7.5 | 250 | +10 | +5 |
| L | | 6.0 | 390 | 0 | −5 |
| M | Acceptable | 6.0 | 395 | −15 | −20 |
| N | | 6.0 | 390 | −20 | −25 |
| O | Example | 6.5 | 400 | −25 | −30 |
| P | Comparative Example | 7.0 | 210 | +5 | +10 |

*8 cycles 200 kg
**shearing tensile strength at 8 cycles, 200 kg and 8 kA

As seen from Tables 4 and 5, the mechanical properties as well as the properties of weld portion and the weldability are poor in Comparative Examples E~L having a chemical composition outside the reasonable range defined in the invention. Furthermore, when the chemical composition is within the reasonable range but the cooling rate is lower than the lower limit defined in the invention (Comparative Example P), the good properties are not obtained.

On the other hand, when the chemical composition and the treating conditions are within the reasonable ranges defined in the invention (Acceptable Examples A~D and M~O), not only the mechanical properties but also the properties of weld portion and the weldability are improved.

EXAMPLE 3

A continuously cast slab having a chemical composition shown in the following Table 6 was heated to 1,250° C. and subjected to a finish hot rolling at 880° C. to form a hot rolled sheet of 3.2 mm in thickness, which was coiled at 550° C. Then, the coiled sheet was subjected to a cold rolling at a reduction of 75% to form a cold rolled sheet of 0.8 mm in gauge, which was subjected to a continuous annealing at a temperature of 750° C.

The mechanical properties of the thus obtained steel sheets as well as the lower limit of reasonable welding current and the welding strength were measured to obtain results as shown in the following Table 7.

Moreover, each of the mechanical properties was represented by an average value in the rolling direction, a direction of 45° with respect to the rolling direction and a direction perpendicular to the rolling direction at a ratio of 1:2:1. The spot welding was carried out by using a CF type electrode of 4.8 mm in diameter at a welding time of 8 cycles and an applied pressure of 200 kgf. The welding strength was evaluated by a value at a welding current of 7.5 kA.

TABLE 6

| Kind of steel | | C | Si | Mn | P | S | Al | N | Ti | Nb | B |
|---|---|---|---|---|---|---|---|---|---|---|---|
| A | Acceptable Example | 0.0024 | 0.01 | 0.15 | 0.010 | 0.010 | 0.018 | 0.0022 | 0.023 | 0.006 | 0.0007 |
| B | Acceptable Example | 0.0030 | 0.01 | 0.14 | 0.010 | 0.012 | 0.021 | 0.0028 | 0.035 | 0.008 | 0.0008 |
| C | Acceptable Example | 0.0015 | 0.01 | 0.14 | 0.011 | 0.007 | 0.020 | 0.0020 | 0.029 | 0.004 | 0.0006 |
| D | Acceptable Example | 0.0019 | 0.01 | 0.14 | 0.010 | 0.010 | 0.024 | 0.0023 | 0.017 | 0.006 | 0.0009 |
| E | Acceptable | 0.0028 | 0.01 | 0.13 | 0.010 | 0.008 | 0.021 | 0.0031 | 0.023 | 0.004 | 0.0003 |

TABLE 6-continued

| | | | | | | | | | | | |
|---|---|---|---|---|---|---|---|---|---|---|---|
| F | Example Comparative Example | 0.0017 | 0.01 | 0.15 | 0.011 | 0.008 | 0.025 | 0.0021 | — | 0.005 | 0.0005 |
| G | Comparative Example | 0.0022 | 0.01 | 0.13 | 0.010 | 0.007 | 0.020 | 0.0035 | 0.033 | — | 0.0003 |
| H | Comparative Example | 0.0038 | 0.02 | 0.15 | 0.011 | 0.011 | 0.021 | 0.0030 | 0.030 | 0.007 | — |
| I | Comparative Example | 0.0020 | 0.01 | 0.15 | 0.011 | 0.010 | 0.019 | 0.0025 | 0.072 | 0.005 | 0.0007 |
| J | Comparative Example | 0.0030 | 0.01 | 0.10 | 0.010 | 0.010 | 0.019 | 0.0019 | 0.005 | 0.006 | 0.0006 |
| K | Comparative Example | 0.0021 | 0.01 | 0.15 | 0.010 | 0.008 | 0.022 | 0.0020 | 0.031 | 0.052 | 0.0007 |
| L | Comparative Example | 0.0024 | 0.01 | 0.10 | 0.011 | 0.009 | 0.030 | 0.0022 | 0.025 | 0.005 | 0.0025 |
| M | Comparative Example | 0.0012 | 0.02 | 0.12 | 0.009 | 0.010 | 0.030 | 0.0015 | 0.020 | 0.004 | 0.0005 |

| Kind of steel | | $\frac{Ti}{\frac{48}{12}C+\frac{48}{14}N}$ | $\frac{Ti}{\frac{48}{12}C+\frac{48}{14}N+\frac{48}{32}S}$ | $B-\frac{11}{93}Nb$ | $\frac{48}{93}\cdot\frac{Nb}{Ti}$ | $C+\frac{12}{14}N+\frac{12}{11}B$ |
|---|---|---|---|---|---|---|
| A | Acceptable Example | 1.3 | 0.7 | −0.00001 | 0.13 | 0.0050 |
| B | Acceptable Example | 1.6 | 0.9 | −0.00015 | 0.12 | 0.0063 |
| C | Acceptable Example | 2.3 | 1.2 | 0.00013 | 0.07 | 0.0039 |
| D | Acceptable Example | 1.1 | 0.6 | 0.00019 | 0.18 | 0.0049 |
| E | Acceptable Example | 1.1 | 0.7 | −0.00017 | 0.09 | 0.0058 |
| F | Comparative Example | — | — | −0.00009 | — | 0.0040 |
| G | Comparative Example | 1.1 | 0.8 | — | — | 0.0055 |
| H | Comparative Example | 1.2 | 0.7 | — | 0.12 | (0.0064) |
| I | Comparative Example | 4.3 | 2.3 | 0.00011 | 0.04 | 0.0049 |
| J | Comparative Example | 0.3 | 0.1 | −0.00011 | 0.62 | 0.0053 |
| K | Comparative Example | 2.0 | 1.1 | −0.0055 | 0.87 | 0.0051 |
| L | Comparative Example | 1.5 | 0.8 | 0.0019 | 0.10 | 0.0070 |
| M | Comparative Example | 2.0 | 0.8 | 0.00033 | 0.10 | 0.0030 |

TABLE 7

| No. | | $\overline{Y.S.}$ (kgf/mm$^2$) | $\overline{T.S.}$ (kgf/mm$^2$) | $\overline{El}$ (%) | $\bar{r}$ | Lower limit of reasonable welding current (kA) | Welding strength (kgf) |
|---|---|---|---|---|---|---|---|
| A | Acceptable Example | 20.0 | 30.2 | 48.7 | 2.0 | 5.5 | 400 |
| B | Acceptable Example | 20.6 | 31.1 | 48.2 | 1.9 | 5.4 | 425 |
| C | Acceptable Example | 19.5 | 29.9 | 51.0 | 2.1 | 5.8 | 350 |
| D | Acceptable Example | 24.4 | 32.0 | 48.1 | 2.0 | 4.7 | 400 |
| E | Acceptable Example | 21.2 | 30.3 | 48.5 | 2.2 | 5.5 | 375 |
| F | Comparative Example | 17.2 | 32.2 | 46.5 | 1.8 | 6.6 | 300 |
| G | Comparative Example | 13.2 | 28.0 | 48.2 | 1.8 | 7.2 | 250 |
| H | Comparative Example | 11.0 | 28.8 | 48.8 | 1.9 | 6.1 | 200 |
| I | Comparative Example | 15.5 | 30.4 | 47.0 | 1.9 | 6.5 | 225 |
| J | Comparative | 14.5 | 30.1 | 48.0 | 1.6 | 6.7 | 300 |

TABLE 7-continued

| No. | | $\overline{Y.S.}$ (kgf/mm²) | $\overline{T.S.}$ (kgf/mm²) | $\overline{El}$ (%) | $\bar{r}$ | Lower limit of reasonable welding current (kA) | Welding strength (kgf) |
|---|---|---|---|---|---|---|---|
| | Example | | | | | | |
| K | Comparative Example | 16.0 | 31.0 | 45.0 | 1.6 | 6.1 | 300 |
| L | Comparative Example | 16.0 | 31.6 | 16.1 | 1.6 | 6.9 | 275 |
| M | Comparative Example | 15.0 | 30.2 | 50.9 | 2.0 | 5.9 | 200 |

As seen from Table 7, all of Ti-Nb-B added extra-low carbon steel sheets according to the invention (kind of steel: A~E) are not only good in the $\bar{r}$-value and $\overline{El}$ and excellent in the deep drawability, but also has a wide lower limit of reasonable welding current in the spot welding and is sufficient in the spot welding strength.

On the contrary, the spot weldability is poor in all of Comparative Examples being outside the reasonable ranges defined in the invention.

EXAMPLE 4

A slab of steel having the same chemical composition as in the steel A of Example 3 was treated under various conditions shown in the following Table 8 to obtain cold rolled sheets (gauge: 0.8 mm).

The mechanical properties of the thus obtained sheets and the spot weldability thereof were measured to obtain results as shown in the following Table 9.

TABLE 8

| No. | | Finish Temperature (°C.) | Coiling Temperature (°C.) | Reduction of cold rolling (%) | Continuous annealing temperature (°C.) | Reduction of skin pass rolling (%) |
|---|---|---|---|---|---|---|
| 1 | Acceptable Example | 880 | 500 | 75 | 750 | 1.2 |
| 2 | Acceptable Example | 850 | 550 | 80 | 780 | 2.5 |
| 3 | Acceptable Example | 800 | 400 | 75 | 750 | 0.9 |
| 4 | Comparative Example | 850 | 700 | 70 | 750 | — |
| 5 | Comparative Example | 850 | 500 | 75 | 880 | 0.3 |
| 6 | Comparative Example | 1000 | 550 | 70 | 770 | 0.4 |
| 7 | Acceptable Example | 850 | 550 | 75 | 750 | 0.4 |
| 8 | Acceptable Example | 800 | 450 | 80 | 750 | — |

TABLE 9

| No. | | $\overline{Y.S.}$ (kgf/mm²) | $\overline{T.S.}$ (kgf/mm²) | $\overline{El}$ (%) | $\bar{r}$ | Lower limit of reasonable welding current (kA) | Welding strength (kgf) | Fatigue strength at low cycle welding $10^5$ cycles (kgf) |
|---|---|---|---|---|---|---|---|---|
| 1 | Acceptable Example | 20.2 | 30.4 | 48.6 | 2.2 | 5.5 | 400 | 230 |
| 2 | Acceptable Example | 21.1 | 30.5 | 48.4 | 2.1 | 5.2 | 425 | 245 |
| 3 | Acceptable Example | 19.2 | 30.1 | 48.8 | 2.1 | 5.9 | 375 | 225 |
| 4 | Comparative Example | 18.8 | 30.2 | 47.7 | 1.7 | 6.1 | 275 | 165 |
| 5 | Comparative Example | 16.9 | 29.8 | 48.6 | 1.9 | 7.0 | 200 | 150 |
| 6 | Comparative Example | 18.0 | 30.8 | 45.5 | 1.6 | 6.7 | 300 | 160 |
| 7 | Acceptable Example | 20.5 | 30.4 | 48.8 | 2.1 | 5.7 | 400 | 205 |
| 8 | Acceptable Example | 19.5 | 30.2 | 49.0 | 2.1 | 5.9 | 375 | 200 |

As seen from Table 9, the steel sheets according to the invention (No. 1~3 and 7~8) exhibit good deep drawability and spot weldability, while when the production conditions are outside the reasonable ranges defined in the invention (No. 4~6), the mechanical properties and the spot weldability are poor.

Particularly, the steel sheets according to the invention subjected to a skin pass rolling at a high reduction (No. 1~3) have a high fatigue strength at low cycle welding and exhibit more improved spot weldability.

EXAMPLE 5

A continuously cast slab of steel having a chemical composition shown in the following Table 10 was heated to and soaked at 1,250° C., and then subjected to a rough rolling and a finish rolling to form a hot rolled sheet of 3.2 mm in thickness. After pickling, the sheet was cold rolled to obtain a cold rolled sheet of 0.7 mm in gauge, which was subjected to a continuous annealing (soaking temperature: 750°~850° C.) and further to a skin pass rolling (reduction: 0.8%).

The skin pass rolling was carried out by using a work roll dulled through laser working (laser dulled roll).

The surface roughness of the steel sheet was measured in the rolling direction thereof, from which an average surface roughness SRa was determined.

The mechanical properties of these steel sheets were measured to obtain results as shown in the following Table 11.

Furthermore, the spot welding was carried out under conditions that the welding time was 7 cycles, the applied pressure was 160 kgf and the current was 6.5 kA, during which the spot weldability was evaluated by a shearing tensile strength. The measured results are also shown in Table 11.

TABLE 10

| Steel | C | Si | Mn | P | S | Ti | Nb | B | Al | N | Remarks |
|---|---|---|---|---|---|---|---|---|---|---|---|
| A | 0.01 | 0.02 | 0.15 | 0.020 | 0.008 | 0.018 | 0.003 | 0.0006 | 0.03 | 0.0020 | Comparative Example |
| B | 0.002 | 0.02 | 0.14 | 0.014 | 0.010 | — | — | 0.0003 | 0.02 | 0.0020 | Comparative Example |
| C | 0.002 | 0.02 | 0.16 | 0.016 | 0.013 | 0.020 | 0.005 | 0.0004 | 0.04 | 0.0015 | Acceptable Example |
| D | 0.0015 | 0.02 | 0.14 | 0.021 | 0.017 | 0.030 | 0.004 | 0.0007 | 0.06 | 0.0015 | Acceptable Example |

TABLE 11

| | | Mechanical properties | | | | | |
|---|---|---|---|---|---|---|---|
| Steel | Surface roughness SRa (μm) | Y.S. (kgf/mm²) | T.S. (kgf/mm²) | El (%) | $\bar{r}$ | Shearing tensile strength (kgf) | Remarks |
| A | 1.0 | 20 | 36 | 42 | 1.3 | 213 | Comparative Example |
| B | 1.1 | 19 | 35 | 44 | 1.4 | 241 | Comparative Example |
| C | 0.7 | 18 | 32 | 49 | 1.9 | 267 | Comparative Example |
| | 1.5 | 16 | 29 | 51 | 2.2 | 304 | Acceptable Example |
| D | 0.7 | 17 | 30 | 50 | 2.0 | 282 | Comparative Example |
| | 1.2 | 17 | 30 | 50 | 2.1 | 319 | Acceptable Example |

As seen from Table 11, the cold rolled steel sheets according to the invention exhibit excellent press formability and spot weldability as compared with those of the comparative examples.

EXAMPLE 6

A slab of steel having the same chemical composition as in the steels C and D of Example 5 was produced in the same manner as in Example 5 and subjected to the following test.

That is, the area ratio of convex portions and the average area per one convex portion at the center face of surface roughness in the resulting cold rolled steel sheets were measured by means of a three-dimensional surface roughness meter.

The surface roughness and mechanical properties of the cold rolled steel sheet are shown in Table 12.

TABLE 12

| | Surface roughness | | Mechanical properties | | | | | |
|---|---|---|---|---|---|---|---|---|
| Steel | SSr (%) | SGr (μm²) | Y.S. (kgf/mm²) | T.S. (kgf/mm²) | El (%) | $\bar{r}$ | Shearing tensile strength (kgf) | Remarks |
| C | 65 | $3 \times 10^4$ | 18 | 31 | 49 | 1.8 | 263 | Comparative Example |
| | 50 | $1 \times 10^4$ | 17 | 30 | 50 | 1.9 | 278 | Comparative Example |
| | 45 | $8 \times 10^4$ | 18 | 30 | 50 | 1.8 | 335 | Acceptable Example |
| D | 70 | $8 \times 10^4$ | 19 | 33 | 45 | 1.7 | 250 | Comparative Example |
| | 30 | $7 \times 10^4$ | 17 | 31 | 51 | 2.0 | 327 | Acceptable |

TABLE 12-continued

| Steel | Surface roughness SSr (%) | Surface roughness SGr ($\mu m^2$) | Mechanical properties Y.S. ($kgf/mm^2$) | T.S. ($kgf/mm^2$) | El (%) | $\bar{r}$ | Shearing tensile strength (kgf) | Remarks |
|---|---|---|---|---|---|---|---|---|
| | | | | | | | | Example |

As seen from Table 12, the all steel sheets according to the invention exhibit excellent press formability and spot weldability as compared with those of the comparative examples.

As mentioned above, according to the invention, the extra-low carbon steel sheets having an improved spot weldability can be obtained without damaging the formability, so that they are suitable for use in applications subjected to spot welding after the press forming such as steel sheets for automobiles and the like.

What is claimed is:

1. A cold rolled steel sheet comprising:

not more than 0.004 wt % C, not more than 0.1 wt % Si, not more than 0.5 wt % Mn, not more than 0.025 wt % P, not more than 0.025 wt % S, not more than 0.0040 wt % N, 0.01~0.04 wt % Ti, 0.003~0.008 wt % Nb, 0.0001-0.001 wt % B, 0.01~0.1 wt % Al and the remainder being substantially Fe; and fine precipitates of Ti having a grain size of not more than 0.05 $\mu m$ uniformly dispersed in said steel in an amount of not less than 30 ppm as a Ti conversion amount.

2. A cold rolled steel sheet comprising:

not more than 0.004 wt % C, not more than 0.1 wt % Si, not more than 0.5 wt % Mn, not more than 0.025 wt % P, not more than 0.025 wt % S, 0.01~0.04 wt % Ti, 0.001~0.008 wt % Nb, 0.0001~0.001 wt % B, 0.01~0.1 wt % Al and the remainder being substantially Fe;

wherein said steel sheet has a surface roughness satisfying either one of the following (a) and (b);

(a) surface roughness (SRa) and yield stress (Y.S.) satisfy the following relationship:

$$SRa \geqq (32.4/Y.S.) - 1.1;$$

(b) an area ratio of convex portions on a surface of said steel sheet (SSr) of not more than 60% and an average area per one convex portion (SGr) of not less than $2 \times 10^4$ $\mu m^2$.

3. The cold rolled steel sheet of claim 1, wherein the amount of Nb present is less than 1/5 (93/48) of the amount of Ti present.

4. The cold rolled steel sheet of claim 2, wherein the amount of Nb present is less than 1/5 (93/48) of the amount of Ti present.

5. The cold rolled steel sheet of claim 1, wherein the amount of Nb present is less than ¼ of the amount of Ti present.

6. The cold rolled steel sheet of claim 2, wherein the amount of Nb present is less than ¼ of the amount of Ti present.

* * * * *